US009683367B1

(12) United States Patent
Ting

(10) Patent No.: US 9,683,367 B1
(45) Date of Patent: Jun. 20, 2017

(54) CURTAIN WALL MULLION ANCHORING SYSTEM

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 15/154,250

(22) Filed: May 13, 2016

Related U.S. Application Data

(60) Provisional application No. 62/298,828, filed on Feb. 23, 2016, provisional application No. 62/303,797, filed on Mar. 4, 2016.

(51) Int. Cl.
*E04B 2/88* (2006.01)
*E04B 2/96* (2006.01)
*E04B 1/41* (2006.01)

(52) U.S. Cl.
CPC ..... *E04B 2/965* (2013.01); *E04B 1/41* (2013.01); *E04B 2/88* (2013.01); *E04B 2/96* (2013.01); *E04B 2/967* (2013.01)

(58) Field of Classification Search
CPC . E04B 1/41; E04B 1/4107; E04B 2/96; E04B 2/88; E04B 2/94; E04B 1/215; E04B 2/967; E04F 13/083; E04C 3/30
See application file for complete search history.

(56) References Cited

U.S. PATENT DOCUMENTS

| | | | |
|---|---|---|---|
| 3,251,168 | A | 5/1966 | Waring et al. |
| 3,321,880 | A | 5/1967 | Ferrell et al. |
| 3,367,077 | A | 2/1968 | Johnston |
| 3,903,671 | A | 9/1975 | Cuin et al. |

(Continued)

FOREIGN PATENT DOCUMENTS

| | | | |
|---|---|---|---|
| CN | 201236597 | Y | 5/2009 |
| EP | 0476289 | A1 | 3/1992 |

(Continued)

OTHER PUBLICATIONS

Notification of Transmittal of the International Search Report and the Written Opinion of the International Searching Authority, or the Declaration, May 15, 2013, PCT Serial No. PCT/US2013/021893.

(Continued)

*Primary Examiner* — Adriana Figueroa
*Assistant Examiner* — Jessie Fonseca
(74) *Attorney, Agent, or Firm* — Beck & Thomas, P.C.

(57) ABSTRACT

Curtain wall mullion anchoring systems for resisting dead load and negative wind load, and that permit three-way construction tolerance adjustments. The mullion anchoring systems include an anchoring device secured to a building structural element and attached to a mullion connection bridge, which is connected to a mullion connection clip, which is connected to a mullion. Uplifting forces on the anchoring device may be significantly reduced or even eliminated by transmitting dead load under negative wind load conditions from the mullion to the anchoring device at a point over the inside of a concrete floor slab, such that the dead load counteracts any uplifting force generated by the negative wind load.

9 Claims, 17 Drawing Sheets

(56) References Cited

U.S. PATENT DOCUMENTS

| | | | | |
|---|---|---|---|---|
| 3,978,629 | A | 9/1976 | Echols, Sr. | |
| 4,055,923 | A | 11/1977 | Biebuyck | |
| 4,449,341 | A * | 5/1984 | Taglianetti | E04B 2/88 52/235 |
| 4,506,482 | A * | 3/1985 | Pracht | E04B 2/88 52/235 |
| 4,543,755 | A | 10/1985 | Crandell | |
| 4,672,784 | A | 6/1987 | Pohlar | |
| 4,685,263 | A | 8/1987 | Ting | |
| 4,765,107 | A | 8/1988 | Ting | |
| 4,840,004 | A | 6/1989 | Ting | |
| 4,873,805 | A | 10/1989 | Ting | |
| 4,977,717 | A | 12/1990 | Niwata | |
| 5,077,947 | A * | 1/1992 | Takeda | E04B 2/94 52/235 |
| 5,158,392 | A * | 10/1992 | Takeda | E04B 2/34 403/315 |
| 5,452,552 | A | 9/1995 | Ting | |
| 5,467,566 | A * | 11/1995 | Swartz | E04B 2/96 52/235 |
| 5,481,839 | A | 1/1996 | Lang et al. | |
| 5,596,851 | A | 1/1997 | Ting | |
| 5,598,671 | A | 2/1997 | Ting | |
| 5,687,524 | A | 11/1997 | Ting | |
| 5,720,571 | A * | 2/1998 | Frobosilo | E04B 2/96 403/2 |
| 5,846,018 | A * | 12/1998 | Frobosilo | E04B 2/96 403/2 |
| 6,393,778 | B1 | 5/2002 | Ting | |
| 6,591,562 | B2 | 7/2003 | Ting | |
| 6,598,361 | B2 | 7/2003 | Ting | |
| 6,715,248 | B2 | 4/2004 | Biebuyck | |
| 6,745,527 | B1 | 6/2004 | Sherman et al. | |
| 7,043,884 | B2 | 5/2006 | Moreno | |
| 7,134,247 | B2 | 11/2006 | Ting | |
| 7,162,842 | B2 | 1/2007 | Ribic | |
| 7,681,366 | B2 | 3/2010 | De Gobbi | |
| 8,001,738 | B2 | 8/2011 | Ting | |
| 8,011,146 | B2 | 9/2011 | Krause | |
| 8,033,066 | B2 | 10/2011 | Griffiths | |
| 8,127,507 | B1 | 3/2012 | Bilge | |
| 8,166,716 | B2 | 5/2012 | MacDonald et al. | |
| 8,191,325 | B2 | 6/2012 | Ting | |
| 8,240,099 | B2 | 8/2012 | Hummel, III | |
| 8,365,481 | B2 | 2/2013 | Scully et al. | |
| 8,402,714 | B2 | 3/2013 | Labrecque | |
| 8,413,403 | B2 | 4/2013 | Walker et al. | |
| 8,511,032 | B2 * | 8/2013 | Abdel-Rahman | E04B 2/88 248/228.1 |
| 8,613,173 | B2 * | 12/2013 | Ander | E04B 2/90 52/235 |
| 9,032,681 | B1 * | 5/2015 | Brady | E04B 1/41 52/404.1 |
| 9,200,444 | B2 * | 12/2015 | Ra | E04B 2/90 |
| 2002/0124514 | A1 | 9/2002 | Higgins | |
| 2002/0144476 | A1 * | 10/2002 | Mastelli | E04B 2/96 52/235 |
| 2002/0148178 | A1 * | 10/2002 | Farag | E04B 2/96 52/204.1 |
| 2002/0184836 | A1 * | 12/2002 | Takeuchi | E04B 1/2403 52/167.1 |
| 2003/0033764 | A1 * | 2/2003 | Ting | E04B 2/96 52/235 |
| 2003/0033765 | A1 * | 2/2003 | Ting | E04B 2/96 52/235 |
| 2003/0150179 | A1 | 8/2003 | Moreno | |
| 2003/0221381 | A1 | 12/2003 | Ting | |
| 2004/0079038 | A1 | 4/2004 | Crooker, Jr. | |
| 2005/0284053 | A1 | 12/2005 | Grunewald et al. | |
| 2006/0016137 | A1 | 1/2006 | Ferro | |
| 2007/0039258 | A1 * | 2/2007 | Walker | E04B 2/96 52/235 |
| 2009/0241444 | A1 | 10/2009 | Griffiths | |
| 2010/0011687 | A1 | 1/2010 | Arias | |
| 2010/0037549 | A1 | 2/2010 | Lynch | |
| 2010/0132293 | A1 | 6/2010 | Voegele et al. | |
| 2010/0257812 | A1 * | 10/2010 | Schultz | E04B 2/96 52/704 |
| 2013/0014636 | A1 | 1/2013 | Dehghanyar | |
| 2013/0186031 | A1 | 7/2013 | Ting | |
| 2015/0211242 | A1 * | 7/2015 | Rosati | E04G 21/3247 414/10 |
| 2016/0040702 | A1 | 2/2016 | Broussard | |

FOREIGN PATENT DOCUMENTS

| | | | |
|---|---|---|---|
| GB | 2397310 | A | 7/2004 |
| JP | 2006016776 | A | 1/2006 |
| KR | 10-2010-0120867 | | 11/2010 |

OTHER PUBLICATIONS

Yakin, Victor J., "Glass Your Online Industry Resource", Glass Magazine (, Jun. 1, 2008, pp. 1-3.

Yakin, Victor J., "Glass Your Online Industry Resource", Glass Magazine, Jun. 1, 2008, p. 1.

Halfen, "Halfen HCW Curtain Wall" Technical Product Information, 2014, pp. 1-36.

Harmon Innovative Facade Solutions, SMU6000 Curtain Wall Anchor Brochure, 2014, pp. 1-2.

Harmon Innovative Facade Solutions, UCW8000 Curtain Wall System Brochure, 2013, pp. 1-2.

Jordahl, "Design of Anchor Channels", Brochure, Oct. 2010, pp. 1-67.

Jordahl, "Anchor Channels jTA-CE", Brochure, Nov. 2013, pp. 1-3.

Jordahl, "Channels and Accessories Making Light Work of the Heaviest Loads", Brochure, Feb. 2013, pp. 1-56.

Knickerbocker, Chuck, Anchored in Reality: Getting Anchors and Embeds Right (http://www.usglassmag.com/fieldnotes/?p=280), Aug. 11, 2012, pp. 1-3.

Yakin, Victor, "Dependable Connections the Anchoring Systems Used to Transmit the Loads . . . ", http://www.glasscanadam.com/business-intelligence/dependable-connections-889, Jul. 31, 2007, pp. 1-3.

Centre for Window and Cladding Technology, Chapter 8 Brackets and Fixings, "CWCT Curtain Wall Installation Handbook", Handbook, Nov. 2001, pp. 1-7.

International Searching Authority, International Search Report and Written Opinion of the International Searching Authority for International Application No. PCT/US16/33045, Oct. 7, 2016.

* cited by examiner

CURTAIN WALL MULLION ANCHORING SYSTEM

CROSS-REFERENCE TO RELATED APPLICATIONS

This application claims the benefit under 35 U.S.C. §119 (e) of the earlier filing dates of U.S. Provisional Patent Application No. 62/298,828 filed on Feb. 23, 2016, and U.S. Provisional Patent Application No. 62/303,797 filed on Mar. 4, 2016.

BACKGROUND OF THE INVENTION

1. Field of the Invention

This invention relates to exterior curtain wall mullion anchoring system design.

2. Description of the Background

An exterior curtain wall system consists of three major components, namely, wall panels providing weather protection, mullions providing structural support to the wall panels, and mullion anchoring systems providing a structural connection between the mullions and a building structural element. Mullion anchoring systems carry the dead load weight of the wall panels and transfer the load to the building structure, typically at the building base or at intermediate floor slabs. Mullion anchoring systems also absorb positive and negative wind loads acting on the wall panels.

Mullion anchoring systems also must allow for construction tolerance adjustments in all three directions (i.e., up/down, left/right, and in/out). The acceptable construction tolerance for curtain wall, typically ±⅛" (3.2 mm) in all directions, is much tighter than the acceptable construction tolerance for the building structural elements, typically ±¾" (19.1 mm) in the up/down direction, ±1" (25.4 mm) in the left/right direction, and ±1" (25.4 mm) to ±2" (50.8 mm) in the in/out direction. Mullion anchoring systems must be designed to absorb these construction tolerances. The three way construction tolerance adjustments are executed in the field individually for each mullion anchoring location.

Mullion anchoring systems may be categorized based on where they are secured to the building structure. For example, mullion anchoring systems may be secured on the face of a floor slab (i.e., edge of slab or slab edge application), on top of a floor slab (i.e., on-slab or top of slab application), or to a support beam or column.

Mullion anchoring systems secured to a concrete floor slab may be further categorized based on how they are secured to the floor slab. For example, a mullion anchoring system may be secured to a concrete slab using concrete anchor bolts installed after the concrete is cured, secured by welding to a weld plate embedded in the concrete when the concrete is poured, or secured using special T-bolts secured to a slotted anchor channel (also referred to as "cast-in channels") embedded in the concrete when the concrete is poured. Mullion anchoring system components embedded in the concrete floor slab when the concrete is poured are commonly referred to as "embeds."

A slab edge embed is commonly used to anchor mullions in a stick system curtain wall. When a typical slab edge embed is used, the mullion anchoring system includes the slab edge embed and mullion connection clips (also referred to as brackets) connecting the embed to the mullion. The clips typically are a pair of L-shaped angles, one on each side of the mullion, each with an anchoring flange secured to the embed and a protruding flange secured to a side of the mullion. Three-way construction tolerance adjustments are normally provided by vertical slotted holes in the mullion for up/down adjustments, horizontal slotted holes in the protruding flange of each mullion connection clip for in/out adjustments, and horizontal slotted holes in the anchoring flange of each mullion connection clip for left/right adjustments. The slab edge embed may have two threaded steel rods (acting as anchor bolts) protruding horizontally outside the floor slab edge for structural bolted connection to the anchoring flanges of the mullion connection clips.

Alternatively, a slab edge embed with an anchor channel (sometimes called a cast-in channel) may be used. If a cast-in channel is used, the mullion connection clips are secured to the channel using a field-installed anchor T-bolt. Left/right adjustments can be made by positioning the anchor T-bolt at the desired left/right location within the channel. Up/down adjustments can be made by using vertical slotted holes either in the mullion or in the anchoring flange of each mullion connection clip. In/out adjustments can be made using a horizontal slotted hole in the protruding flange of each mullion connection clip.

In a mullion anchoring system with a slab edge embed, the up/down adjustment must be done with a temporary dead weight support first, followed by simultaneous adjustments in the other two directions before tightening up all connection bolts. For erection safety and quality, the above procedures require handling relatively light weight mullions without attached wall panels, such as in a curtain wall stick system or airloop system.

Some functional disadvantages of slab edge embed anchoring systems include: (1) They require punching or notching through the slab edge concrete stop before pouring concrete for the protruding threaded steel rods for the connection bolts or for the exposure of the anchor channel; (2) It is extremely difficult to remedy incorrectly located embeds after the concrete slab cures; (3) In case of incorrectly located holes in the mullion, the mullion must be re-fabricated in the shop, causing potential job delays; (4) Quality control inspection is more time consuming since the anchoring components are outside the slab edge.

Some functional advantages of a slab edge embed anchoring system include: (1) The embed condition likely will not be damaged or displaced by the concreting operation; (2) Only light hoisting equipment is required to erect the mullions.

Some structural problems of a slab edge embed anchoring system include: (1) The anchor bolts are subjected to both shear and tensile stresses due to dead and cyclic wind loads, causing potential stress fatigue; (2) Use of slotted holes for construction tolerance adjustments means the structural connection strength against wind load reaction becomes a function of the distance from the connection bolt to the center of the slotted hole; therefore, either the worst condition or a higher safety factor must be considered; (3) Using slotted holes for left/right adjustment results in uneven wind load reactions on the double L-shaped mullion connection clips causing twisting of the mullion, producing potential sealant line failure or wall panel connection failure.

Mullion anchoring systems that include an on-slab embed are commonly used for a unitized system where heavy curtain wall units are involved. In a typical on-slab embed anchoring system, an anchor channel is partially embedded in a concrete floor slab when the concrete is poured. A bracket is secured to the anchor channel using anchor T-bolts, and the bracket is engaged with mullion connection clips that are fastened to the mullion.

Three-way construction tolerance adjustments for this type of on-slab embed are normally executed by the following procedures: (1) Hoist the curtain wall unit to be erected and engage it to the adjacent erected unit to form the vertical wall joint; (2) Position the bracket at the desired right/left location along the anchor channel; (3) Using slotted holes in the bracket, move the bracket to the desired in/out position for engaging it with the mullion connection clips that are attached to the mullion; (4) Lower the wall unit down to cause simultaneous structural engagements between the mullion connection clip and the bracket, and between the wall unit and the erected unit below to form the horizontal wall joint; (5) Fix the bracket in position by securing the anchor T-bolts to the anchor channel; (4) Drop down the unit to completely engage the horizontal wall joint below with the weight being supported on the bracket; (5) Use a vertical set-screw in the mullion connection clip to accomplish the up/down horizontal wall joint line to be within the acceptable tolerance range of ±⅛" (3.2 mm); (6) After final vertical joint gap adjustment if necessary, secure the unit against horizontal walking and release the hoist.

Some functional disadvantages of an on-slab embed anchoring system include: (1) It requires heavy hoisting equipment for the erection; (2) It is difficult to maintain the design position of the embed due to the fact that the embeds are often inadvertently kicked out of position or buried inside the slab during concreting operations, and it is costly to remedy the problem of incorrectly located embeds.

Some functional advantages of an on-slab embed anchoring system compared to a slab edge embed anchoring system include: (1) Various remedy options can be used for incorrectly located embeds after concrete curing; (2) It is easy to execute reliable field quality inspection due to the on-slab location of the anchoring system.

Some structural problems of prior art on-slab embed anchoring systems include: (1) The dead load reaction is transmitted from the mullion connection clip to a point on the bracket that overhangs the floor slab edge, and the overhanging distance depends on the amount of in/out construction tolerance adjustment. This creates a variable bending moment on the bracket at the slab edge and a variable uplifting long term load on the anchor T-bolts that secure the bracket to the anchor channel embed. Due to the variable bending moment and uplifting long term load, the bracket and the anchor T-bolts must be designed for the condition of maximum outward construction tolerance adjustment. (2) The up/down tolerance adjustment is normally provided by a set-screw type of device at the dead load supporting point in the mullion connection clip. The connection strength between the mullion connection clip and the bracket varies due to the change of the depth of structural engagement between mullion connection clip and bracket caused by the up/down tolerance adjustment. (3) The combined dead load and wind load reactions produce both a pull-out force and a shear force on the anchor T-bolts. To obtain adequate structural strength of the anchor channel embed, a minimum distance from the embed to the slab edge and a minimum embed depth are required. (4) The maximum up/down tolerance adjustment that can be provided by a set-screw type of device in the mullion connection clip is rather limited, typically ±¾" (19.1 mm), while the practical up/down construction tolerance of the slab edge surface is often in the range of +1.5" (38.1 mm). It is cost prohibitive to solve this problem by relocating the mullion connection clip in the field since it will significantly slow down field productivity. Therefore, it is common field practice to level from the high points on the slab surface, typically at the column locations and to use shims on the bracket at the low points to fulfill the maximum ±¾" (19.1 mm) up/down adjustability. The impairment of anchoring strength due to shimming is largely ignored.

In prior art on-slab mullion anchoring systems, the uplifting force on the anchoring device generated by dead load is a long term load. To resist this long term uplifting force, prior art systems use anchoring devices secured to the concrete floor slab either using large anchoring bolts or components embedded in the concrete when the concrete is poured.

BRIEF SUMMARY OF THE INVENTION

Preferred embodiments of the present invention are directed to mullion anchoring systems that permit adjustments in all three directions to absorb large construction tolerances, and that significantly reduce or eliminate the uplifting force on the anchoring device caused by dead load and wind load. Significant reduction or elimination of the uplifting force permits use of anchoring devices anchored to a cured concrete floor slab using small concrete anchors such as TAPCON concrete screw anchors.

Preferred embodiments of the mullion anchoring systems include three components (1) an anchoring device for attachment to a building structural element (e.g., a floor slab, beam, or column), (2) a mullion connection bridge for connection to the anchoring device and connection to a mullion connection clip, and (3) a mullion connection clip for attachment to a mullion.

In preferred embodiments, those three components permit three-way tolerance adjustments as follows: (1) adjustments in the up/down direction are permitted by relative positioning between the mullion and mullion connection clip; (2) adjustments in the in/out direction are permitted by relative positioning between the mullion connection clip and mullion connection bridge; and (3) adjustments in the left/right direction are permitted by relative positioning between the mullion connection bridge and the anchoring device. Preferred embodiments permit construction tolerance adjustments with virtually no maximum limit.

Preferred embodiments transmit dead load force over a building structural element (e.g., a concrete floor slab) at a point inside of the floor slab edge. Those preferred embodiments eliminate the overturning moment pivoted at the floor slab edge created by mullion anchoring systems that transmit dead load force over a point outside the floor slab edge. Elimination of that overturning moment eliminates uplifting force on the anchoring device created by dead load. In a preferred embodiment, the dead load force exerted by the mullion and wall panels is transmitted to the anchoring device via contact between a horizontal surface of the anchoring device and a horizontal surface of the mullion connection clip and/or a horizontal surface of the mullion connection bridge.

In preferred embodiments, the mullion connection bridge and anchoring device meet via contact between an inward-facing surface of a load resisting lip of the anchoring device and an outward-facing surface of the mullion connection bridge. The contact between those surfaces absorbs negative wind load without creating significant uplifting force on the anchoring device. In preferred embodiments, the dead load reaction point on the anchoring device shifts inward under negative wind load conditions, such that the dead load counteracts any uplifting force generated by negative wind load.

Additional advantages of various preferred embodiments of the present invention include easy installation, ability to anchor curtain wall mullions to a concrete floor slab without using anchor bolts, ability to anchor curtain wall mullions to a concrete slab using concrete screw anchors, ability to make construction tolerance adjustments in all three directions without affecting anchoring strength, and ability to anchor curtain wall mullions to a spandrel beam or column.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF THE INVENTION

Figure 2:
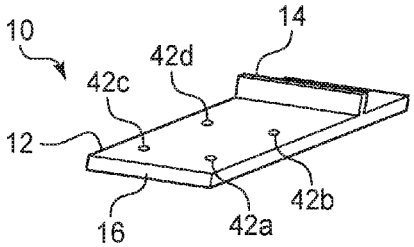
FIG. 2 shows an isometric view of the anchoring device depicted in the installed mullion anchoring system of FIG. 1.

Reference will now be made in detail to the preferred embodiments of the present invention, examples of which are illustrated in the accompanying drawings.

In order to better explain the working principles of the invention, the following will list terminology that will be used herein along with illustrative examples of the terminology. The list of terminology and illustrative examples are not intended to depart from or limit the plain and ordinary meaning of the terminology:

Mullion: one of a plurality of spaced apart structural members generally in the vertical direction used to structurally support weather sealing exterior wall panels. A mullion may be vertical or sloped, depending on the architectural design.

Anchoring Device: a structural device designed for anchoring a mullion at the wind and dead load reaction point onto a building structural element, such as a concrete floor slab or a building frame element such as a spandrel beam or a column. An anchoring device secured to a concrete floor slab may be partially cast in the concrete floor slab during concreting operations, or may be secured to concrete floor slab with concrete anchors after the concrete floor slab is cured.

Mullion Anchoring System: a structural system having a mullion connection clip, a mullion connection bridge, and an anchoring device. A mullion anchoring system provides the ability to make three-way construction tolerance adjustments, and transmits dead load and/or wind load reaction forces from a mullion at a mullion anchoring point into a final anchoring point within the building structure such as a concrete floor slab, a spandrel beam, or a column.

Mullion Connection Clip: a clip structurally secured to a mullion at a mullion connection point.

Mullion Connection Bridge: a clip structurally connecting a mullion connection clip and an anchoring device.

Mullion Connection Assembly: a structural assembly comprising a mullion connection clip and a mullion connection bridge Load Resisting Lip: a structural lip in the mullion anchoring system designed for resisting negative wind load reaction forces, and optionally for resisting dead load and/or positive wind load reaction forces.

In a preferred embodiment of the present invention, a mullion anchoring system comprises an anchoring device for attachment to a building structural element (e.g., a floor slab, beam, or column) and a mullion connection assembly for connecting a mullion to the anchoring device and for transferring reaction forces on the mullion onto the anchoring device. The anchoring device may be attached to the building structural element in a variety of manners, such as embedding in concrete, using fasteners, or welding to a steel beam.

In a preferred embodiment, the mullion connection assembly comprises a mullion connection bridge and a mullion connection clip, wherein the mullion connection bridge attaches to the anchoring device and the mullion connection clip attaches to the mullion connection bridge and the mullion. The anchoring device comprises a load resisting lip with an upstanding, generally inward-facing surface. The mullion connection bridge comprises an upstanding, generally outward-facing surface that contacts the upstanding, generally inward-facing surface of the load resisting lip. Left/right adjustments to account for construction tolerance can be made by relative positioning of the upstanding surfaces of the load resisting lip and the mullion connection bridge. Under negative wind load conditions, a contact pressure develops between the surfaces to resist the negative wind load. The mullion connection bridge may be attached to the anchoring device using a fastener through the mullion connection bridge and the load resisting lip of the anchoring device.

In a preferred embodiment, the mullion connection bridge further comprises a side-facing, generally vertical surface for engagement with a corresponding side-facing, generally vertical surface of a mullion connection clip. In/out adjustments to account for construction tolerance can be made by relative positioning of the side-facing generally vertical surfaces of the mullion connection bridge and mullion connection clip and use of a slotted hole in either the mullion connection bridge or the mullion connection clip. The mullion connection bridge and mullion connection clip may be attached to each other using a fastener secured through the slotted hole.

In a preferred embodiment, the mullion connection clip is slidably engaged with a mullion using matching male and female joints, such that the mullion connection clip may be slidably positioned in the vertical direction to any vertical position along the length of the mullion. Such slidable engagement allows for automatic adjustment to account for construction tolerances in the up/down direction.

In another preferred embodiment, the mullion connection clip is secured to the mullion using fasteners. In yet another preferred embodiment, the mullion connection clip and the mullion have matching profiles that allow for engagement to form a structural engaged joint.

In a preferred embodiment, the anchoring device is attached to a concrete floor slab. The anchoring device may be attached to the concrete floor slab by being embedded in the concrete during concreting operations, or may be attached to a cured concrete floor slab using fasteners. In other preferred embodiments, the anchoring device is secured to a column or spandrel beam.

In preferred embodiments, the mullion connection assembly transmits dead load force from a mullion to the anchoring device at a point inside the outside edge of the floor slab. The dead load force may be transmitted from the mullion connection assembly to a horizontal surface of the anchoring device. In a preferred embodiment, a mullion connection clip transmits dead load force to a horizontal surface of a load resisting lip of the anchoring device.

Figure 1:
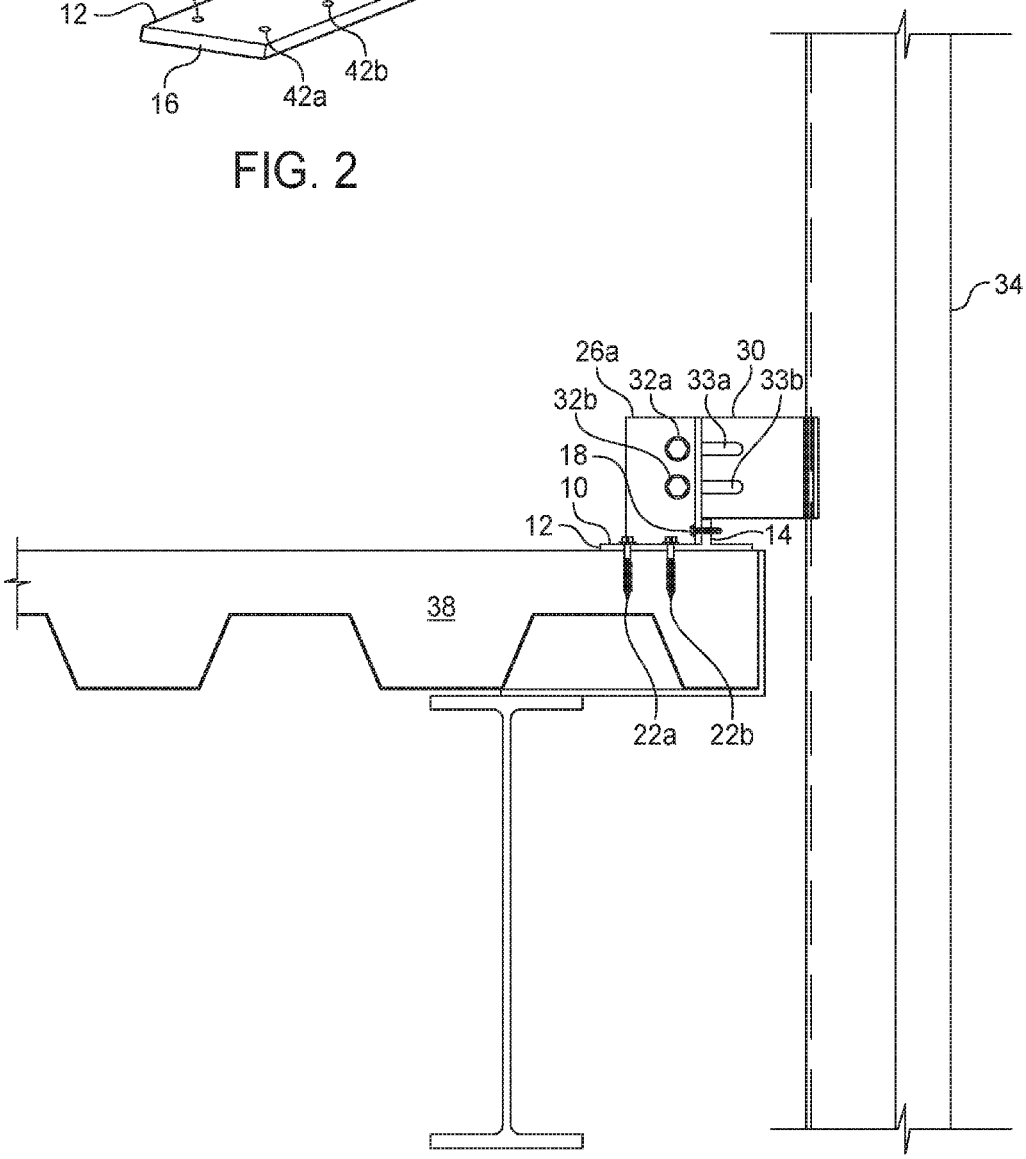
FIG. 1 is a partial fragmental vertical cross-section of a typical slab edge condition showing a preferred embodiment of an installed mullion anchoring system, secured on top of a concrete floor slab.

FIG. 1 shows a partial fragmental vertical cross-section of a typical slab edge condition showing an installed mullion anchoring system of a preferred embodiment of the present invention. In this embodiment, an anchoring device 10 is secured on top of a cured concrete floor slab 38 using fasteners 22*a*, 22*b*. The anchoring device 10 has a horizontal leg 12 and an upstanding load resisting lip 14. Fasteners 22*a* and 22*b* secure the anchoring device 10 to the concrete floor slab through holes in the horizontal leg 12 of the anchoring device 10.

A mullion connection assembly that includes a mullion connection bridge 26*a* and a mullion connection clip 30 connects a mullion 34 to the anchoring device 10. A fastener 18 secures the mullion connection bridge 26*a* to the load resisting lip 14 of the anchoring device 10. The mullion connection bridge 26*a* is secured to the mullion connection clip 30 with fasteners 32*a*, 32*b*, and the mullion connection clip 30 is attached to mullion 34.

FIG. 2 shows an isometric view of the anchoring device 10 depicted in the installed mullion anchoring system of FIG. 1. The anchoring device 10 has a horizontal leg 12 and an upstanding load resisting lip 14. The horizontal leg 12 has screw holes 42*a*, 42*b*, 42*c*, 42*d*, through which fasteners may be placed for securing the anchoring device 10 to a concrete floor slab.

Figure 3:
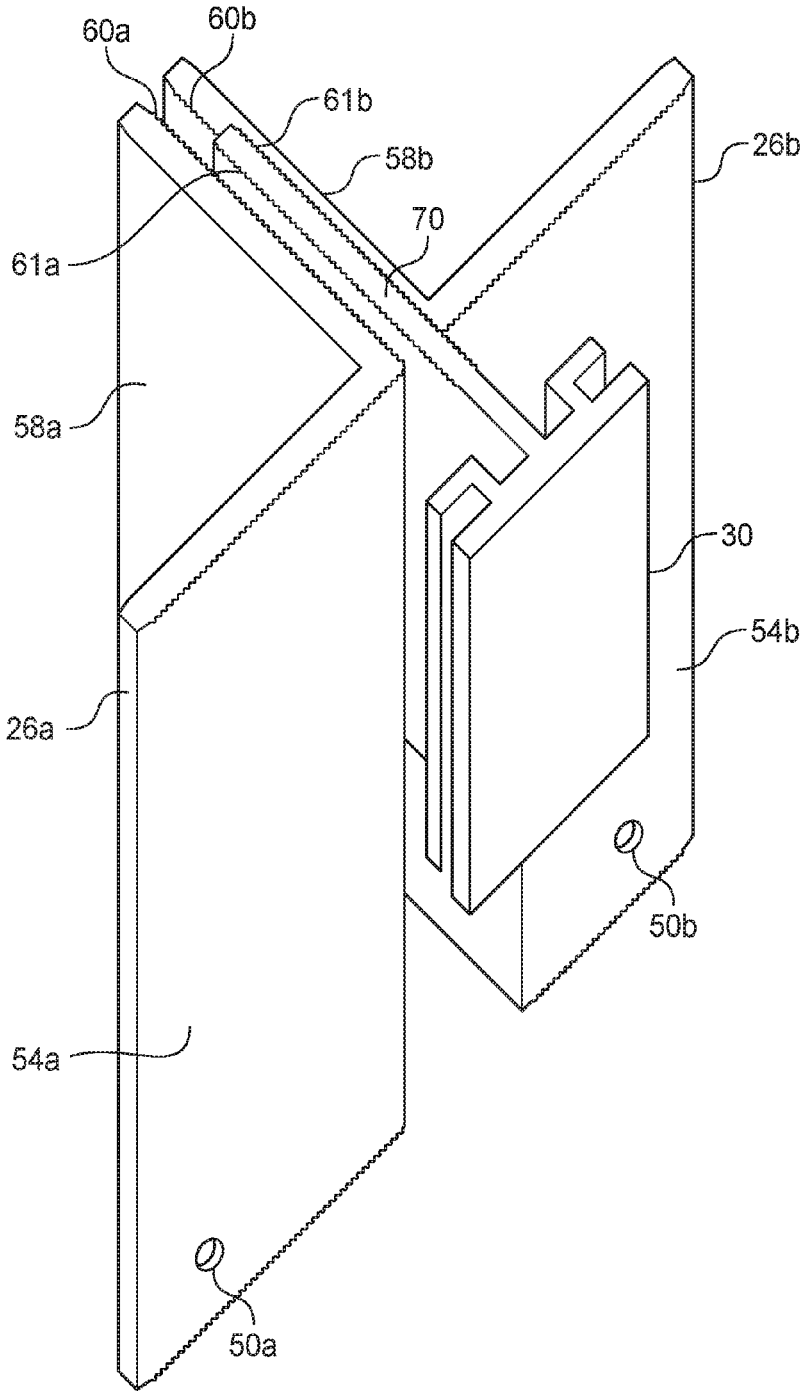
FIG. 3 shows an isometric view of the mullion connection assembly depicted in the installed mullion anchoring system of FIG. 1.
Figure 4:
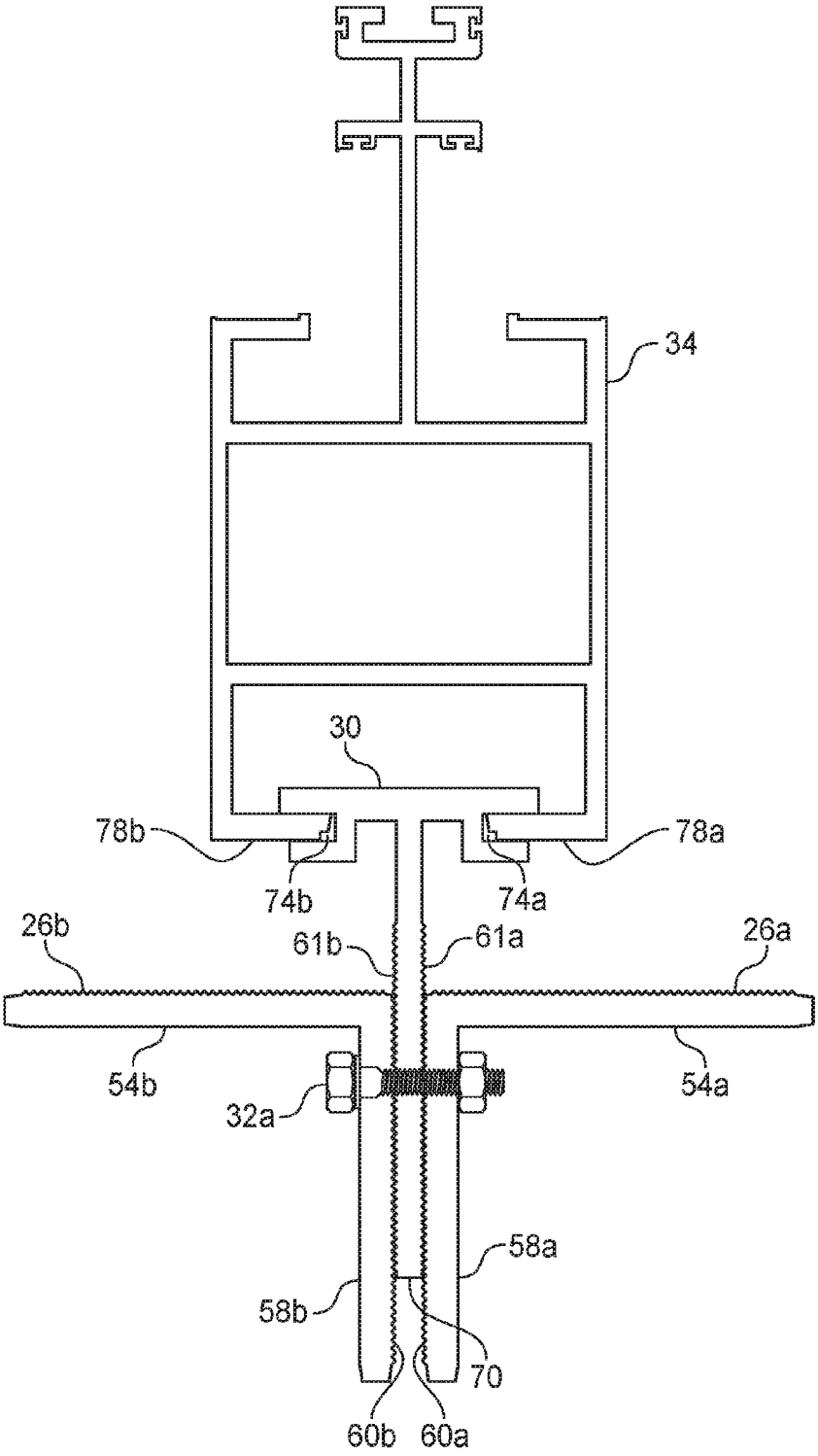
FIG. 4 shows a top view of the mullion connection assembly engaged with the mullion depicted in the installed mullion anchoring system of FIG. 1.
Figure 5:
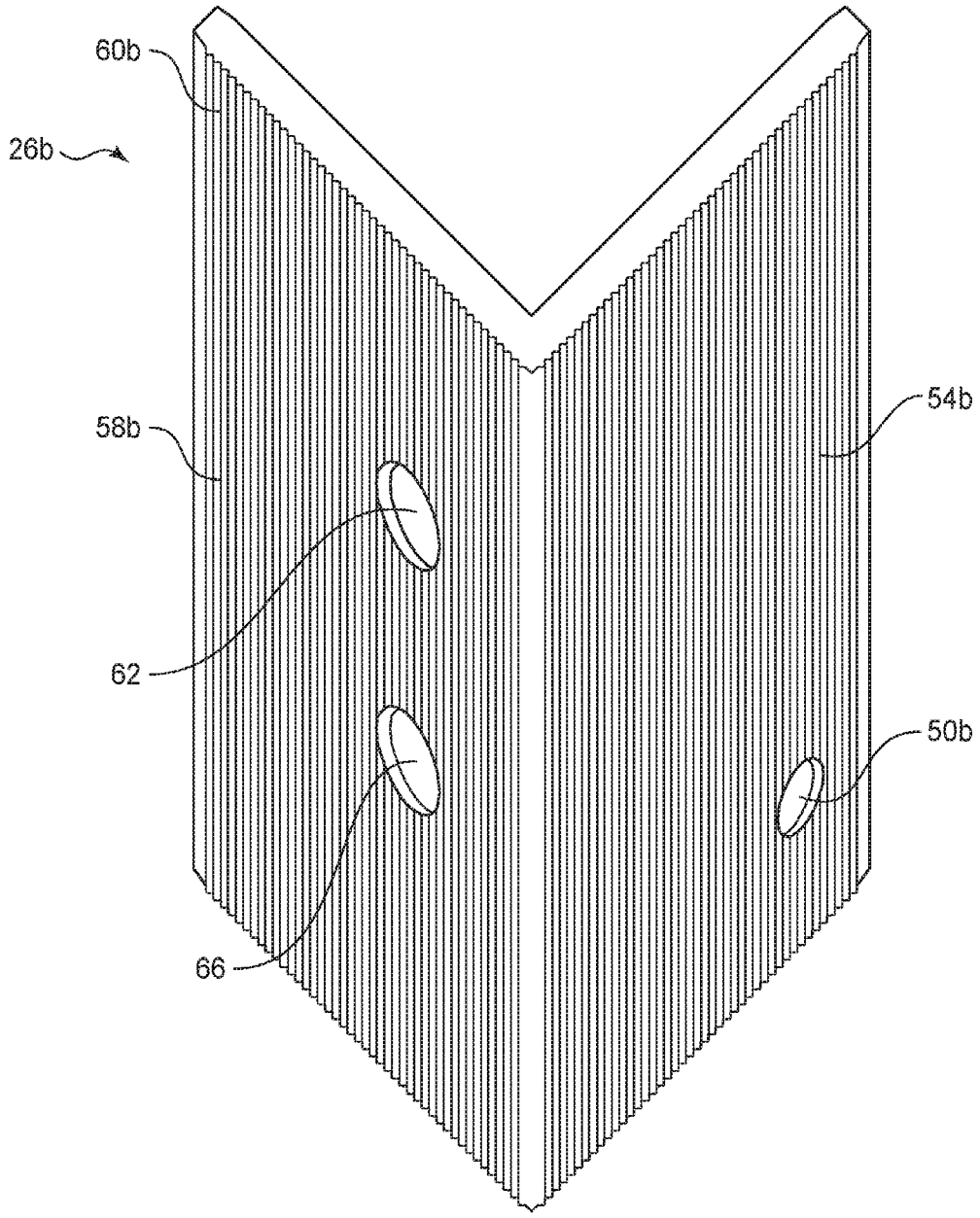
FIG. 5 is an isometric view of a mullion connection bridge for use in a preferred embodiment of a mullion anchoring system.
Figure 6:
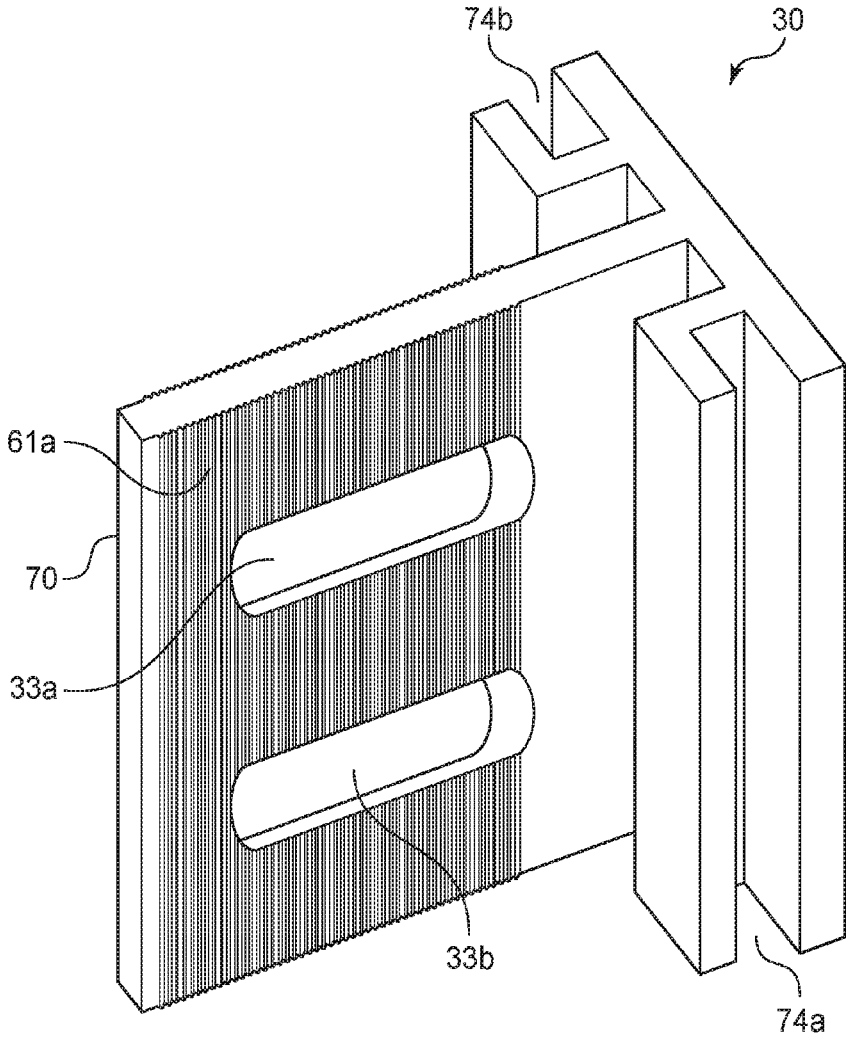
FIG. 6 is an isometric view of a mullion connection clip for use in a preferred embodiment of a mullion anchoring system.

FIG. 3 shows an isometric view of the mullion connection assembly depicted in the installed mullion anchoring system of FIG. 1, and FIG. 4 shows a top view of the mullion connection assembly engaged with a mullion. In this embodiment, the mullion connection assembly includes a mullion connection clip 30 sandwiched between two mullion connection bridges 26*a*, 26*b*. In other embodiments, only one mullion connection bridge is used. FIG. 5 shows an isometric, close up view of one of the mullion connection bridges 26*b*, and FIG. 6 shows an isometric, close up view of the mullion connection clip 30.

Each mullion connection bridge 26*a*, 26*b* preferably is angle shaped with a first angle leg 54*a*, 54*b* and a second angle leg 58*a*, 58*b*. Each mullion connection bridge 26*a*, 26*b* preferably is made of aluminum extrusion. The first angle leg 54*a*, 54*b* of each mullion connection bridge 26*a*, 26*b* has an outward facing surface. As shown in the embodiment of FIG. 1, when the curtain wall anchoring system is assembled, the outward facing surface of each mullion connection bridge 26*a*, 26*b* contacts an inward facing surface of the load resisting lip 14 of the anchoring device 10. In a preferred embodiment, a pre-drilled fastener hole 50*a*, 50*b* is provided in the first angle leg 54*a*, 54*b* of each mullion connection bridge 26*a*, 26*b*. A fastener 18 may be placed through each fastener hole 50*a*, 50*b* to secure each mullion connection bridge 26*a*, 26*b* to the load resisting lip 14 of the anchoring device 10.

For a stick or airloop curtain wall system, the left/right mullion position will be fixed once the panels are secured between the mullions. Therefore, the fastener 18 may be unnecessary. During erection, a temporary position fixer such as a clamp may be used until the panels are secured at the final location.

Prior to securing each mullion connection bridge 26*a*, 26*b* to the load resisting lip 14 of the anchoring device 10 using fastener 18, left/right construction tolerance adjustments may be made by placing each mullion connection bridge 26*a*, 26*b* at the desired left/right location along the load resisting lip 14 of the anchoring device 10. Because this embodiment utilizes an anchoring device 10 that can be installed onto a cured concrete floor slab, the anchoring device 10 does not need to be placed prior to pouring the concrete. Thus, left/right tolerance adjustments can also be achieved by simply installing the anchoring device 10 at the desired left/right location.

In theory, there is no limit on the allowable left/right construction tolerance adjustment. Multiple anchoring devices may be placed side-by-side along the slab edge. If anchoring devices are secured along the entire length of the slab edge to form a continuous load resisting lip, there is no limit to the allowable right/left construction tolerance.

The second angle leg 58*a*, 58*b* of each mullion connection bridge 26*a*, 26*b* has a side facing, vertical surface 60*a*, 60*b*. Each of the side facing, vertical surfaces contacts a side facing, vertical surface 61*a*, 61*b* of a connection leg 70 of a mullion connection clip 30. As shown in FIGS. 1 and 4, the mullion connection bridges 26*a*, 26*b* are secured to the mullion connection clip 30 using fasteners 32*a*, 32*b* placed through the second angle leg 58*a*, 58*b* of each mullion connection bridge 26*a*, 26*b* and the connection leg 70 of the mullion connection clip 30.

In a preferred embodiment, the fasteners 32*a*, 32*b* are bolts secured through each mullion connection bridge 26*a*, 26*b* and through horizontal slotted holes 33*a*, 33*b* in the mullion connection clip 30. The slotted holes 33*a*, 33*b* in the mullion connection clip permit in/out construction tolerance adjustments by permitting in/out positioning of the mullion connection clip relative to the mullion connection bridges 26*a*, 26*b* prior to securing fasteners 32*a*, 32*b*.

As shown in FIG. 5 for one of the mullion connection bridges 26*b*, each mullion connection bridge preferably has pre-drilled holes 62, 66 through which fasteners 32*a*, 32*b* are secured. In another preferred embodiment, horizontal slotted holes are provided in the second angle leg 58*a*, 58*b* of each mullion connection bridge 26*a*, 26*b* to permit in/out construction tolerance adjustments.

In a preferred embodiment, the side facing, vertical surfaces 60*a*, 60*b* of each second angle leg 58*a*, 58*b* of each mullion connection bridge 26*a*, 26*b* has vertical serrations. The side facing, vertical surfaces 61*a*, 61*b* of the connection leg 70 of the mullion connection clip 30 have matching vertical serrations. When the mullion connection assembly is installed, the serrations on the vertical surfaces 60*a*, 60*b* of each mullion connection bridge 26*a*, 26*b* structurally interlock with the matching serrations on the vertical surfaces 61*a*, 61*b* of the mullion connection clip 30 to prevent relative in/out sliding between each mullion connection bridge 26*a*, 26*b* and the mullion connection clip 30.

A preferred embodiment of a mullion connection clip 30 has female joints 74*a*, 74*b* for slidable engagement with matching male joints 78*a*, 78*b* of a mullion 34, as described in U.S. patent application Ser. No. 13/742,887 (published as U.S. Patent Application Publication No. 2013/01860314), which is incorporated by reference herein. This slidable engagement between the mullion connection clip 30 and the mullion 34 resists wind load reactions and can provide up/down construction tolerance adjustments to any location along the length of the mullion. Alternative configurations for the joints between the mullion connection clip and mullion are explained in U.S. patent application Ser. No. 13/742,887 (published as U.S. Patent Application Publication No. 2013/01860314), and additional alternatives could be designed by those of skill in the art.

In preferred embodiments, the mullion connection bridges 26*a*, 26*b* and the mullion connection clip 30 are fabricated from structural members manufactured with a constant profile by a continuous line process such as aluminum extrusions or hot/cold rolled steel members. The centroidal axis of a profiled member is commonly known as the line passing through the centroid of the profile and parallel to the length direction of the member. For purposes of defining the centroidal axis, the length direction of a member is the direction of view for which the member has a continuous profile. In preferred embodiments, the centroidal axes of the mullion connection bridges 26*a*, 26*b* and mullion connection clip 30 are parallel to the centroidal axis of the mullion 34.

With reference to FIGS. 1-6, a preferred embodiment of the mullion anchoring system of the present invention may be installed, and curtain wall mullions anchored to the mullion anchoring system as follows. After the concrete floor slab 38 is cured, the anchoring device 10 is placed at the desired location and secured to the concrete floor slab using fasteners 22*a*, 22*b*.

The mullion connection assembly is loosely assembled by loosely fastening bolts 32*a*, 32*b* through predrilled holes 62, 66 of each mullion connection bridge 26*a*, 26*b*, and the slotted holes 33*a*, 33*b* of the mullion connection clip 30, so that the mullion connection clip 30 is sandwiched between the two mullion connection bridges 26*a*, 26*b* (as shown in FIGS. 3 and 4). The female joints 74*a*, 74*b* of the mullion connection clip 30 are engaged with the corresponding male joints 78*a*, 78*b* of the mullion 34 at the top of the mullion. The mullion connection assembly is slid down the mullion 34 to the anchoring device 10, such that the mullion connection clip 30 rests on top of the load resisting lip 14 of the anchoring device 10. The slidable engagement between the mullion connection clip 30 and the mullion 34 automatically absorbs any up/down construction tolerance deviation since the slidable engagement permits placement of the mullion connection assembly at any location along the length of the mullion 34, and results in the mullion connection assembly being automatically placed at the proper up/down location for attachment to the anchoring device 10.

In/out construction tolerance adjustments can then be made by utilizing the slotted holes 33*a*, 33*b* in the mullion connection clip 30 to slide the mullion connection clip 30 in the in/out direction relative to the mullion connection bridges 26*a*, 26*b* and bolts 32*a*, 32*b*. Bolts 32*a*, 32*b* are secured in place when the desired in/out construction tolerance adjustment is made, causing structural engagement of the serrations on the side-facing surfaces 60*a*, 60*b* of the mullion connection bridges 26*a*, 26*b* with the matching serrations on the side-facing surfaces 61*a*, 61*b* of the mullion connection clip 30.

Left/right construction tolerance adjustments are made by sliding the mullion connection assembly along the top of the load resisting lip 14 of the anchoring device 10. The mullion connection assembly is secured to the anchoring device 10 at the desired right/left location by applying a fastener 18 through the mullion connection bridge 26*a* and the load resisting lip 14 of the anchoring device 10. The fastener 18 prevents horizontal walking of the mullion connection assembly along the top of the load resisting lip 14.

Figure 7A:
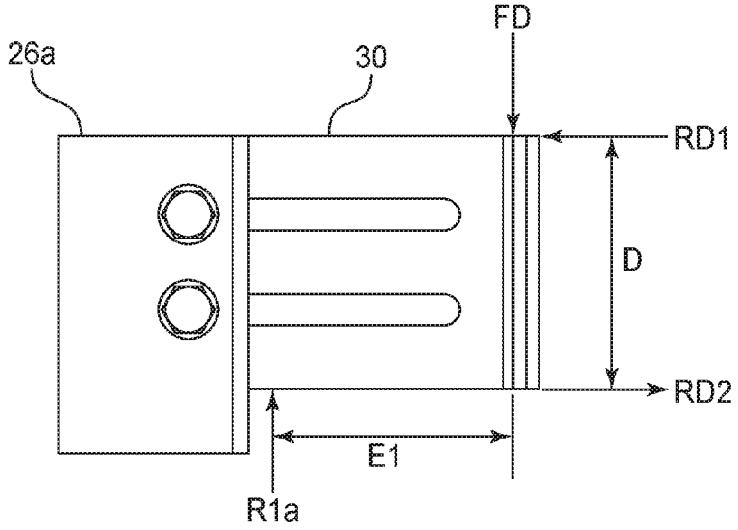
FIG. 7A is an exploded view of the preferred mullion anchoring system shown in FIG. 1, showing dead load forces acting upon the mullion connection assembly and anchoring device.
Figure 7A:
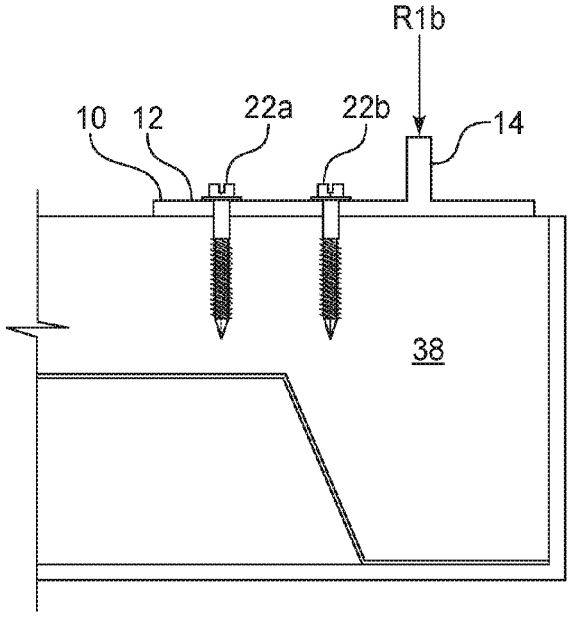
Figure 7B:
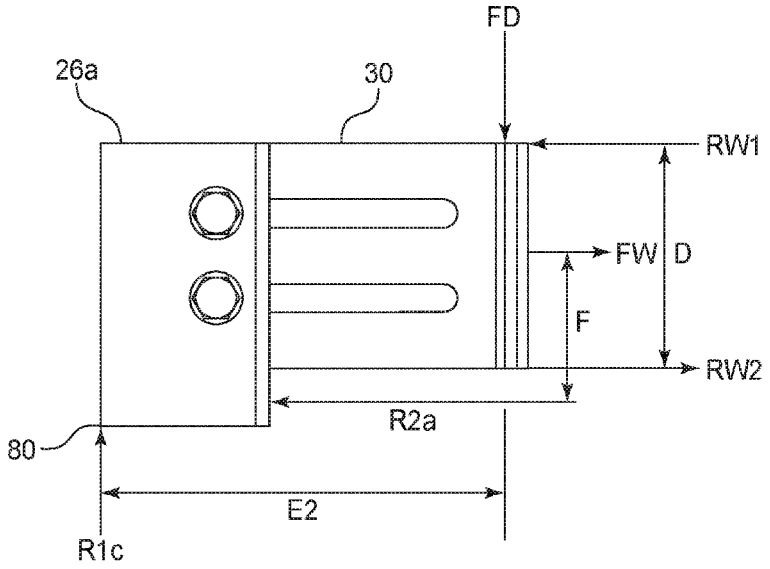
FIG. 7B is an exploded view of the preferred mullion anchoring system shown in FIG. 1, showing combined dead load and negative wind load forces acting upon the mullion connection assembly and anchoring device under negative wind load conditions.
Figure 7B:
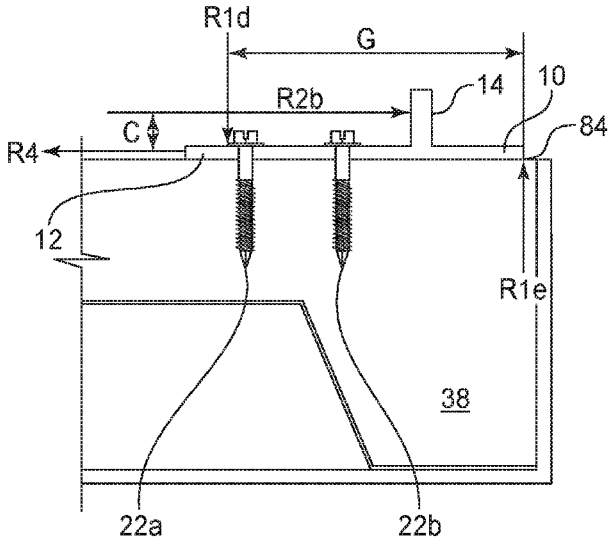
Figure 8:
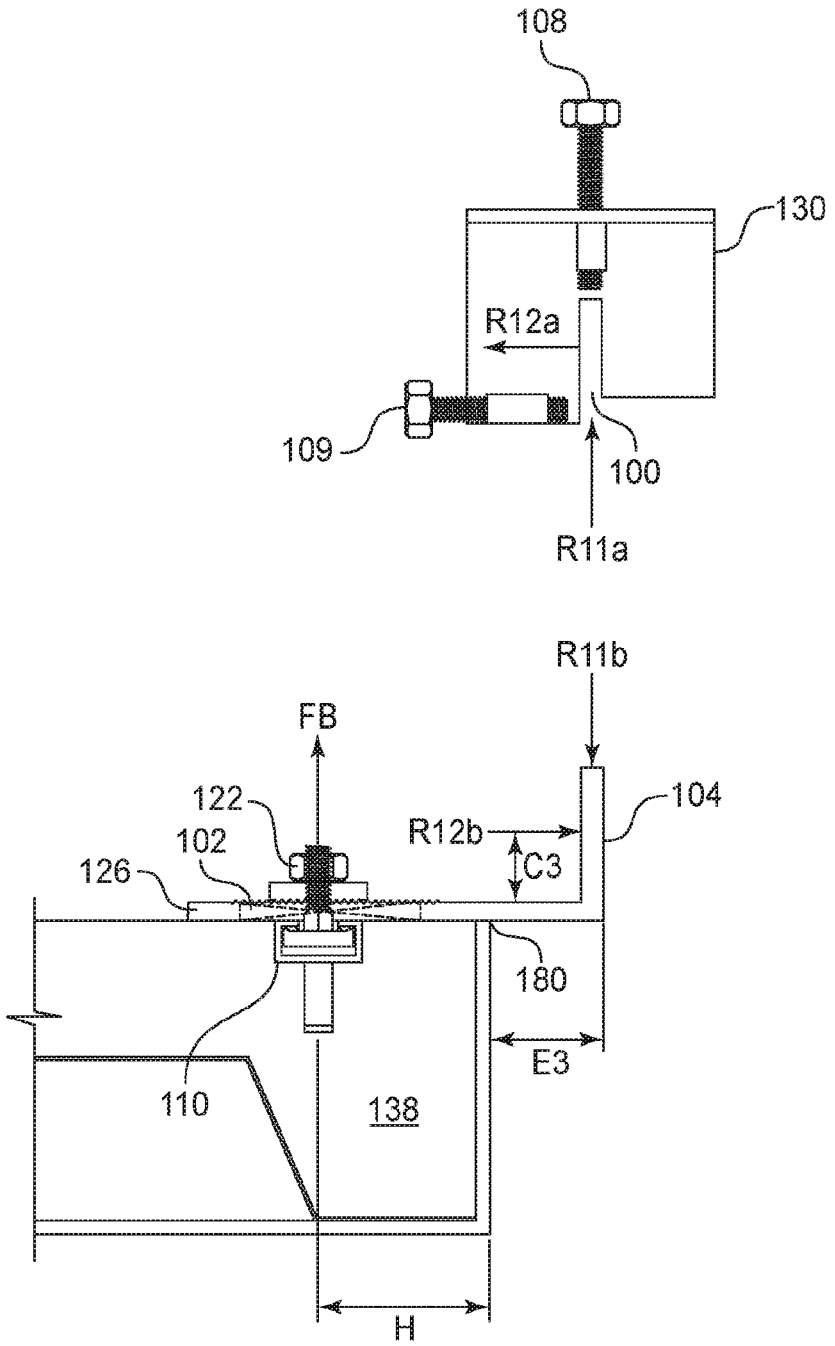
FIG. 8 (PRIOR ART)
FIG. 8 is an exploded view of a prior art mullion anchoring system, showing combined dead load and negative wind load forces acting upon different components of the system under negative wind load conditions.

Some of the advantages of the present invention can be illustrated with free body diagrams showing the forces acting upon the elements of a preferred mullion anchoring system of the present invention and the forces acting upon the elements of a prior art mullion anchoring system. FIGS. 7A and 7B are close up, exploded views of the preferred mullion connection system shown in FIG. 1. FIG. 7A shows dead load forces acting upon the mullion connection assembly and anchoring device, and FIG. 7B shows combined dead load and negative wind load forces acting upon the mullion connection assembly and anchoring device. For comparison, FIG. 8 shows forces acting upon components of a prior art mullion anchoring system.

FIG. 7A illustrates the effect of dead load on a preferred mullion anchoring system, in the absence of wind. FIG. 7A shows a free body diagram showing forces acting upon the mullion connection assembly, and a free body diagram showing forces acting upon the anchoring device. In this preferred embodiment, the mullion connection clip 30 sits on top of load resisting lip 14 of the anchoring device 10, and the mullion connection bridge 26*a* sits on top of the horizontal leg 12 of the anchoring device 10. The mullion connection clip 30 and mullion connection bridge 26*a* together form a mullion connection assembly that is a rigid structural element due to the structural engagement of the serrations on the mullion connection clip 30 and mullion connection bridge 26*a*, which prevents relative displacement and rotation between the mullion connection clip 30 and mullion connection bridge 26*a*.

On the mullion connection assembly, the dead load FD transmitted from the mullion 34 acts near the tip of the mullion connection clip 30 and produces a reaction force R1*a* with equal magnitude in the opposite direction at the point of contact between the mullion connection clip 30 and the load resisting lip 14 of the anchoring device 10. The dead load FD and reaction force R1*a* create an active clockwise moment with a moment arm of dimension E1. Due to the strong structural engagement between the mullion connection clip 30 and the mullion 34, the active clockwise moment is resisted by a reactive counterclockwise moment with the reactive force couple RD1, RD2 and a moment arm of dimension D equal to the height of the mullion connection clip 30.

The magnitude of reactive forces RD1, RD2 is calculated by the following equation:

$$RD1=RD2=FD\times E1/D$$

Thus, reactive forces RD1, RD2 can be reduced by reducing the dimension E1 and/or increasing the dimension D. The dimension D may be easily increased by increasing the height of the mullion connection clip 30. Thus, the mullion connection system design may be adjusted to accommodate varying dead loads by altering the height of the mullion connection clip.

On the anchoring device 10, the dead load reactive force R1*b* acts on top of the load resisting lip 14 where the mullion connection clip 30 contacts the load resisting lip 14. Since dead load reactive force R1*b* acts at a point over the concrete slab 38, the dead load reactive force R1*b* will not create any pull-out force on the fasteners 22*a*, 22*b*.

FIG. 7B illustrates a negative wind load condition by showing the combined effect of dead load and negative wind load on the preferred mullion connection system of FIG. 1. FIG. 7B includes a free body diagram showing forces acting upon the mullion connection assembly, and a free body diagram showing forces acting upon the anchoring device. As explained above, in this preferred embodiment, the mullion connection clip 30 sits on top of load resisting lip 14, and the mullion connection bridge 26*a* sits on top of the horizontal leg 12 of the anchoring device 10.

A negative wind load on the mullion 34 will cause an outward mullion deflection. Because the anchoring point is towards the top of the mullion 34, this outward mullion deflection will cause a small stress-free counterclockwise rotation of the mullion connection assembly before the reactive force couple RW1, RW2 on the mullion connection clip 30 can develop. This is due to the necessary design tolerance between mullion 34 and the mullion connection clip 30 for slidable engagement. This small counterclockwise rotation may cause a change of the dead load reaction point from the top of the load resisting lip 14 to a tip point 80 at the inner end of the second angle leg of the mullion connection bridge 26*a*.

On the mullion connection assembly, a clockwise moment is produced by the active negative wind load force FW acting at the vertical center of the mullion connection clip 30 and the reactive force R2*a* created by the contact between the first angle leg of the mullion connection bridge 26*a* and the load resisting lip 14. This clockwise moment has a moment arm of dimension F, which is the vertical distance between the vertical center of the mullion connection clip 30 and the vertical center of the load resisting lip 14.

Another clockwise moment is produced by the active dead load force FD and the reactive force R1*c* with a moment arm of dimension E2. These two combined clockwise moments are resisted by the reactive counterclockwise moment produced by the force couple RW1, RW2 with a moment arm of dimension D due to the structural engagement between the mullion connection clip 30 and the mullion 34. The reactive counterclockwise moment produced by RW1, RW2 will create a stressed counterclockwise rotation on the mullion connection assembly to ensure the pivoting point 80.

The magnitude of reactive forces RW1, RW2 is calculated from the equation for the balance of the moments as shown below.

$$RW1=RW2=(FW\times F+FD\times E2)/D$$

Thus, reactive forces RW1, RW2 can be reduced by reducing the dimension E2 and/or increasing the dimension D. The dimension D may be easily increased by increasing the height of the mullion connection clip 30. Although increasing the dimension D also increases the dimension F, F increases only about half as much as D. Because of this, and as apparent from the above equation, an increase in D, even with corresponding increase in F, results in a reduction of reactive forces RW1 and RW2. Thus, the mullion connection system design may be adjusted for varying dead and wind loads by altering the height of the mullion connection clip.

On the anchoring device 10, a clockwise active moment is produced by the negative wind load reaction force R2*b* acting at the contact point between the load resisting lip 14 and the mullion connection bridge 26*a*, and reactive force R4 acting at the inner end of the anchoring device 10, with a moment arm of dimension C. This clockwise active moment, Ma, is calculated by the following equation.

$$Ma=R2b\times C$$

Also, a counterclockwise active moment pivoting at pivot point 84 at the outer end of anchoring device 10 is produced by the dead load reaction force R1*d* acting at the contact point 80 between the mullion connection bridge 26*a* and the anchoring device 10, and reactive force R1*e* acting at pivot point 84, with a moment arm of dimension G. This counterclockwise active moment, Mb, is calculated by the following equation.

$$Mb=R1d\times G$$

Because the clockwise active moment Ma will tend to create an uplifting load on fasteners 22*a*, 22*b*, while counterclockwise moment Mb will tend to counteract that load, there will be zero uplifting load on the fasteners 22*a*, 22*b* if Mb>Ma. Thus, the dead load force will reduce or eliminate the uplifting load on the concrete anchors.

This structural behavior represents a major advantage over conventional curtain wall anchoring systems, in which the dead load increases the uplifting load on the concrete anchors. In preferred embodiments of the present invention, uplifting force may be minimized or even eliminated by reducing dimension C (e.g., by reducing the height of load resisting lip 14) and/or increasing dimension G (e.g., by increasing the depth of the connection leg 70 of the mullion connection clip, and/or by increasing the depth of the second angle leg 58*a*, 58*b* of each mullion connection bridge 26*a*, 26*b*).

Small concrete screw anchors have a high shear resistance, but low uplifting load resistance. The low uplifting load resistance prevents their use in conventional curtain wall anchoring systems. Since eliminating or significantly reducing the uplifting load on the concrete fasteners can be achieved by preferred embodiments of the present invention, the use of small concrete screw anchors to secure the anchoring device 10 becomes viable for easy installation and significant cost savings.

The following example calculations are used to demonstrate the effectiveness of this method to prevent uplifting force on anchoring device 10.

Design Conditions:

1. Negative wind load reaction, R2*b*=3000 pounds (1363.6 kg)
2. Dead load reaction, R1*d*=500 pounds (227.3 kg)
3. C=0.5" (12.7 mm) (i.e., half the height of a 1" load resisting lip)
4. G=4" (101.6 mm)

Overturning Moment, Ma=3000×0.5=1500 inch-pounds (17,318 kg-mm)

Counter Dead Load Moment, Mb=500×4=2000 inch-pounds >Ma

From the above design, there will be zero uplifting force on the concrete fasteners 22*a*, 22*b*.

Variations on this preferred embodiment may be made as long as the mechanism used to secure the anchoring device is designed to adequately resist any uplifting force that might be generated. For example, the load resisting lip may overhang the edge of the slab. In that circumstance, dead load in a no wind condition will generate an uplifting force on the anchoring device. Under negative wind load conditions, however, the dead load reaction point shifts such that the dead load counteracts any uplifting force generated by negative wind load. Thus, the uplifting force is significantly reduced compared to other mullion anchoring systems.

Preferred embodiments also may be modified for the anchoring device to have two lips—the load resisting lip in contact with the mullion connection bridge to resist negative wind load, and an outer lip upon which the mullion connection clip rests to absorb dead load in a no wind condition.

For comparison, FIG. 8 is an exploded view of a prior art conventional anchoring system showing force diagrams for elements of the prior art conventional anchoring system. This prior art anchoring system is anchored to the building structure using an on-slab channel embed 110 embedded in a concrete slab 138. A bracket 126 is secured to the channel embed 110 with an anchor T-bolt 122 secured in the channel of the channel embed 110. Typically, at least two anchor T-bolts are used for each anchoring location. The bracket 126 has a male joint 104 to structurally engage a female joint 100 of a mullion clip 130. This structural engagement resists negative wind load. The mullion clip is secured to a mullion (not shown).

Construction tolerance adjustments for this anchoring system are made as follows. Left/right construction tolerance adjustments are made by securing the bracket 126 using anchor T-bolt 122 fastened at the desired right/left location in the channel of the channel embed 110. In/out construction tolerance adjustments are made using a slotted hole 102 in the bracket 126. The anchor T-bolt fastens bracket 126 to the channel embed 110 through slotted hole 102 at the desired in/out location.

Up/down construction tolerance adjustments are made using set bolt 108 on the mullion clip 130. Two mullion clips 130 are fastened to the mullion in the shop at the theoretical up/down location, with one mullion clip on each side of the mullion. During field installation of the anchoring system, upon the completion of left/right adjustment and the joint engagement between male joint 104 of the bracket 126 and female joint 100 of the mullion clip 130, a set bolt or screw 109 on the mullion clip 130 is applied to secure the mullion clip 130 to the bracket 126. Set bolt 108 on the mullion clip 130 provides final up/down construction tolerance adjustability and resists dead load.

On the mullion clip 130, the dead load reaction force R11*a* produces a reaction force R11*b* of equal magnitude in the opposite direction acting on top of the male joint 104 of the bracket 126. The negative wind load reaction force R12*a* on the mullion clip 130 produces a reaction force R12*b* of equal magnitude in the opposite direction acting on the male joint 104 of the bracket 126.

The dead load and wind load reaction forces R11*b*, R12*b* on the male joint 104 of the bracket 126 both produce a clockwise overturning moment on the bracket 126. A clockwise overturning moment on the bracket 126 due to dead load is produced by the reaction force R11*b* with a moment arm of distance E3 pivoting at the pivot point 180.

A clockwise overturning moment on the bracket 106 due to negative wind load is produced by the reaction force R12*b* with a moment arm of distance C3, also pivoting at the pivot point 180.

The dead load and wind load moments on the bracket 126 pivoting at pivot point 180 will produce an uplifting force FB on the anchor T-bolt 122 with a moment arm of distance H, measured from the center of the anchor T-bolt 122 to the pivot point 180. The uplifting force FB on the bolt 122 is calculated from the equivalency of moments as follows:

$$FB=(R11b\times E3+R12b\times C3)/H$$

The anchor T-bolt 122 and channel embed 110 must be designed for the worst condition of maximum uplifting force FB. The distance E3 may vary because in/out construction tolerance adjustments are made by relative in/out positioning of bracket 126. Thus, this worst condition is produced by the maximum outward construction tolerance adjustment (i.e., maximum E3), and limits the amount of possible in/out construction tolerance adjustment.

A typical example calculation is given below.

Condition: Dead Load Reaction, R11*b*=500 pounds

Negative Wind Load Reaction, R12*b*=2000 pounds

H=3" by design.

Maximum Allowable in/out construction tolerance=+1" (i.e., E3=2")

Maximum Allowable up/down construction tolerance=+¾"

(i.e., C=1" with the consideration of ½" room for set bolt 109)

FB=(500×2+2000×1)/3=1000 pounds

From the above, using a normally acceptable safety factor of 3.0, the anchoring system must be designed for an ultimate strength of 3000 pounds (i.e., 3×FB) against uplifting force in combination with an ultimate shear strength of 6000 pounds (i.e., 3×R12*b*).

Preferred embodiments of the present invention also improve upon prior art mullion anchoring systems by increasing allowable construction tolerance adjustments and mitigating negative effects of construction tolerance adjustments. As explained above, up/down construction tolerance adjustments in preferred embodiments are achieved through slidable engagement of a mullion connection clip with a mullion using matching female and male joints. Such slidable engagement permits the mullion connection clip to be located at any vertical location along the length of the mullion, and the vertical location does not affect the full engagement of the mullion connection clip with the mullion, the full engagement of the mullion connection clip with the mullion connection bridge, or the full engagement of the mullion connection bridge with the anchoring device. Thus, connection strength of the mullion anchoring system is not impacted by up/down construction tolerance adjustments, and up/down construction tolerance adjustments can be made to any vertical location along the length of the mullion.

In contrast, connection strength is impacted by up/down construction tolerance adjustments in prior art mullion anchoring systems. For example, in the on-slab channel embed mullion anchoring system shown in FIG. 8, up/down adjustments using set bolt 108 affect the depth of engagement between the female joint 100 of the mullion clip 130 and the male joint 104 of the bracket 126, impacting the engaged joint strength between the mullion clip 130 and bracket 126. Thus, maximum allowable up/down adjustment is limited. Other prior art systems that provide up/down construction tolerance adjustments using vertical slotted holes in the mullion or mullion clip also have variable connection strength based on the location of the securing bolt relative to the center of the slotted hole.

Preferred embodiments of the present invention also may be designed to accommodate different amounts of in/out construction tolerance adjustment by increasing the depth and height of the mullion connection clip. The depth of the mullion connection clip may be increased to permit a greater range of in/out construction tolerance adjustment. Increasing the depth of the mullion connection clip 30 will increase the reactive forces on the mullion connection assembly, as explained in the descriptions of FIGS. 7A and 7B (dimension E1 and FIG. 7A and dimension E2 in FIG. 7B will increase). However, as also explained in the descriptions of FIGS. 7A and 7B, the reactive forces may be reduced by increasing the height of the mullion connection clip 30. Thus, the height of the mullion connection clip 30 may be increased to reduce reactive forces on the mullion connection assembly to offset an increase in reactive forces caused by increasing the depth of the mullion connection clip 30. Further, as explained in the description of FIGS. 7A and 7B, increasing the depth of the mullion connection clip will not increase any uplifting force on concrete fasteners 22*a*, 22*b* that secure the anchoring device 10 to the concrete slab 38. Thus, the design of the mullion anchoring system can be adjusted to accommodate large in/out construction tolerances by simply increasing the depth and height of the mullion connection clip.

As shown in FIG. 1, due to the orientation of the mullion connection clip 30, the use of slotted holes 33*a*, 33*b* to make in/out construction tolerance adjustments does not result in variable connection strength since the mullion connection clip 30 is designed to be in tension in the longitudinal direction of the slotted holes 33*a*, 33*b*.

By contrast, in/out construction tolerance adjustments in prior art mullion anchoring systems impact connection strength and have limited range. For example, in the on-slab channel embed system shown in FIG. 8, in/out adjustments are made using slotted hole 102 in the bracket 126. As explained in the description of FIG. 8, increased outward construction tolerance adjustments are limited because such adjustments increase the uplifting force FB on anchor T-bolt 122. Additionally, in/out adjustments result in variable connection strength based on the location of the anchor T-bolt 122 relative to the center of the slotted hole 102. Unlike preferred embodiments of the present invention, this prior art mullion anchoring system does not provide any design solution to offset the increased forces resulting from increased in/out construction tolerance adjustments.

Preferred embodiments of the present invention also permit simple right/left construction tolerance adjustments along the right/left length of the load resisting lip of the anchoring device. As explained above, multiple anchoring devices may be placed along the entire length of a floor slab to provide a continuous load resisting lip along the entire length of the floor slab, which would permit right/left construction tolerance adjustments to any right/left location.

In prior art systems, the need for anchoring devices able to withstand long term uplifting forces makes such an arrangement cost prohibitive. Additionally, prior art systems that use slotted holes for right/left adjustments have variable connection strength based on the location of the securing bolt relative to the center of the slotted hole.

Figure 9:
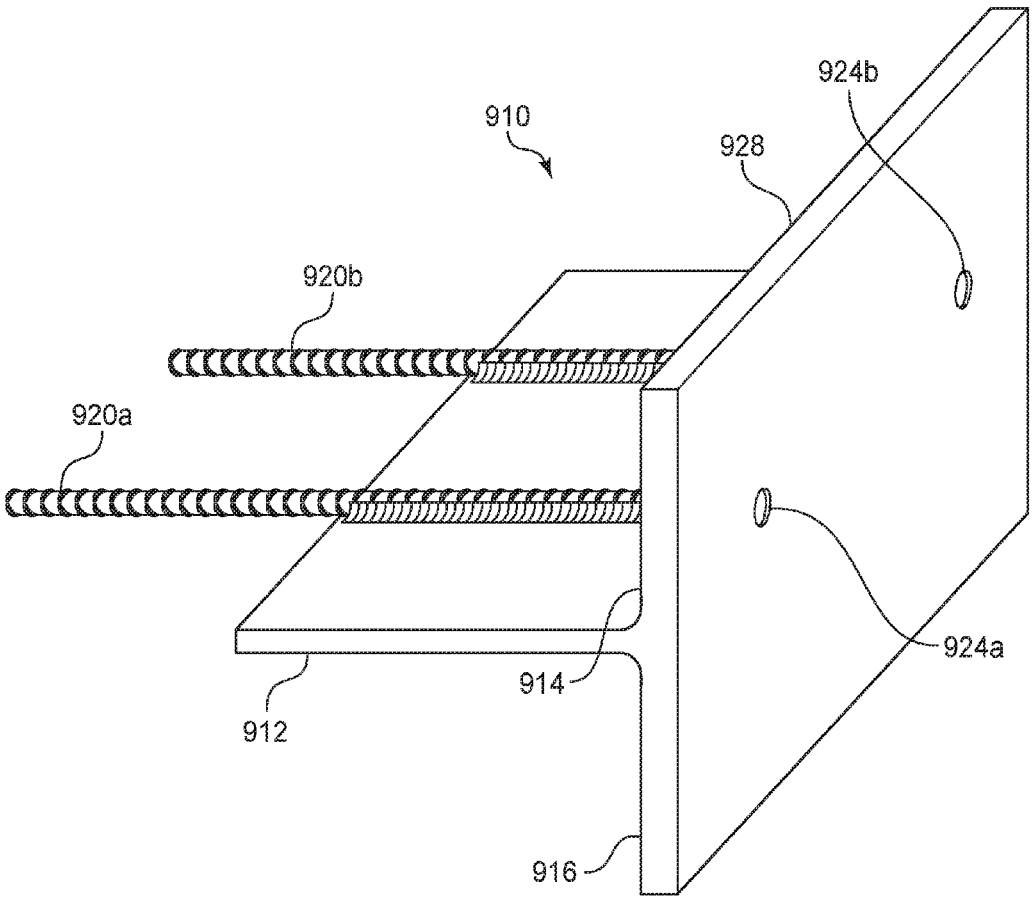
FIG. 9 is an isometric view of an embed anchoring device for use in a preferred embodiment of a mullion anchoring system.
Figure 10:
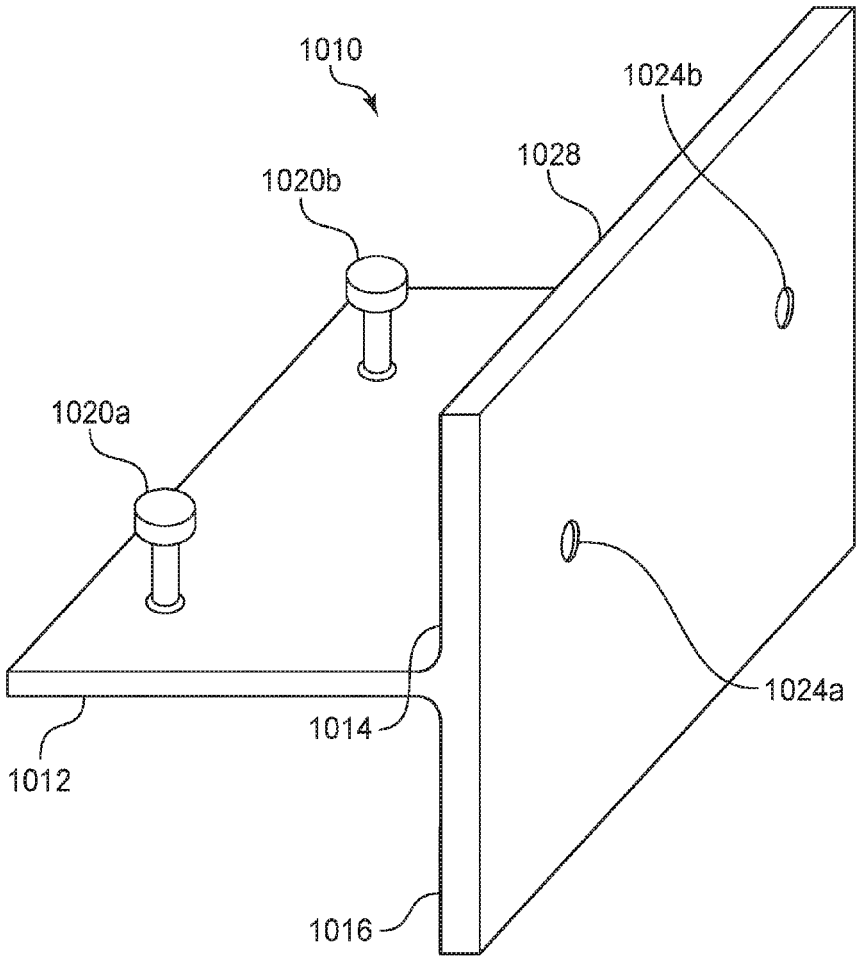
FIG. 10 is an isometric view of another embed anchoring device for use in a preferred embodiment of a mullion anchoring system.
Figure 11:
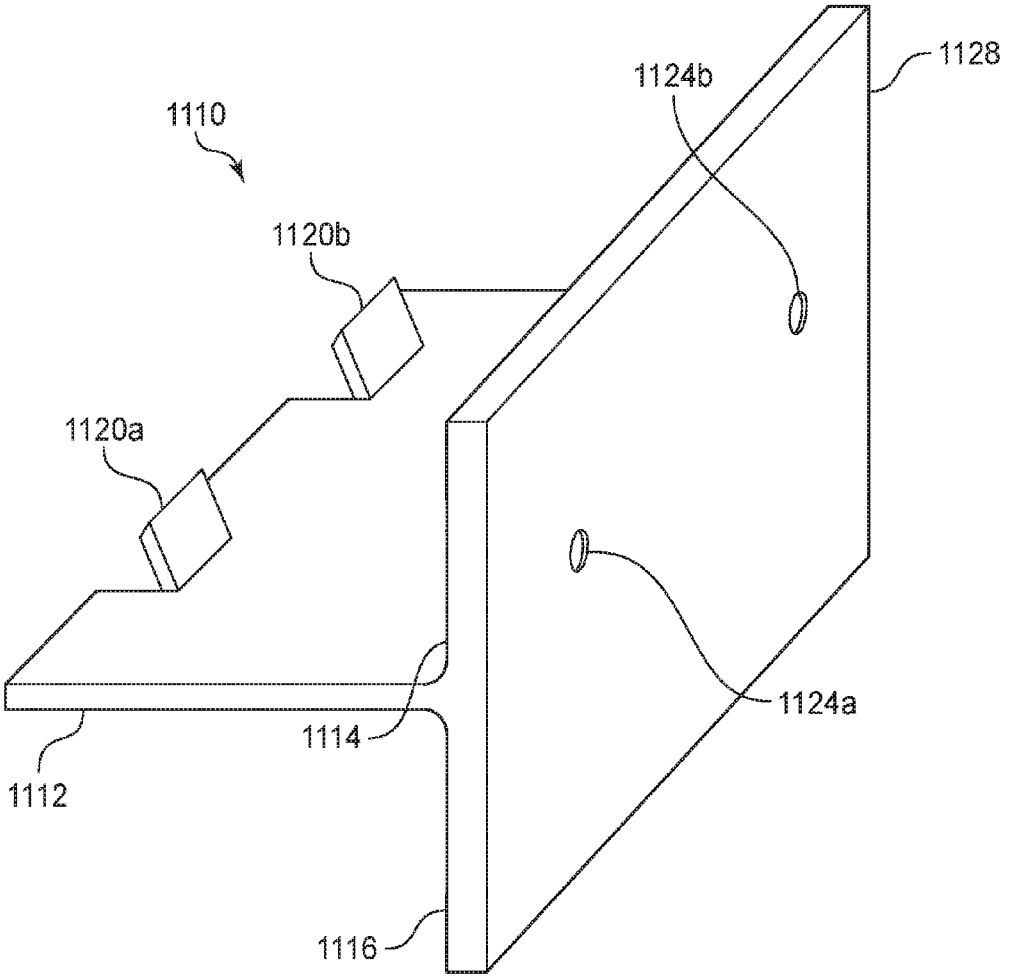
FIG. 11 is an isometric view of another embed anchoring device for use in a preferred embodiment of a mullion anchoring system.

In certain preferred embodiments, the anchoring device is embedded in a concrete floor slab when the concrete is poured. FIGS. 9-11 show embodiments of embed anchoring devices. Preferred embed anchoring devices have a structural connection element and at least one concrete locking device. The structural connection element has a horizontal web to be embedded in the concrete and an upwardly extended flange to be positioned at the concrete floor slab edge. The upwardly extended flange provides a load resisting lip that protrudes above the top surface of the floor slab when installed. Such embed anchoring devices can be used in conjunction with mullion connection bridges and mullion connection clips as described for other mullion anchoring system embodiments.

FIG. 9 shows one preferred embodiment of an embed anchoring device 910. The embed anchoring device 910 has a structural connection element 928 welded to steel reinforcing bars 920*a*, 920*b* as concrete locking devices. The structural connection element 928 is T-shaped with a horizontal web 912, an upwardly extended flange 914, and an optional downwardly extended flange 916. The horizontal web 912 is embedded in the concrete floor slab when installed. The upwardly extended flange 914 is positioned at the floor slab edge when installed. When the embed anchoring device 910 is installed, the upper portion of the upwardly extended flange 914 protrudes above the top surface of the floor slab to provide a load resisting lip. The upwardly extended flange in this embodiment has predrilled fastener holes 924*a*, 924*b*, through which fasteners may be placed to temporarily secure the embed anchoring device 910 to slab edge formwork during concreting operations.

FIG. 10 shows another preferred embodiment of an embed anchoring device 1010. This embodiment has a T-shaped structural connection element 1028 with a horizontal web 1012, upwardly extended flange 1014 with fastener holes 1024*a*, 1024*b*, and downwardly extended flange 1016, similar to the embodiment shown in FIG. 9. For concrete locking devices, this embodiment has steel studs 1020*a*, 1020*b* welded to the structural connection element 1028.

FIG. 11 shows another preferred embodiment of an embed anchoring device 1110. This embodiment has a T-shaped structural connection element 1128 with a horizontal web 1112, upwardly extended flange 1114 with fastener holes 1124*a*, 1124*b*, and downwardly extended flange 1116, similar to the embodiments shown in FIGS. 9 and 10. For concrete locking devices, this embodiment has bent tabs 1120*a*, 1120*b* integral to the structural connection element 1028.

Figure 12:
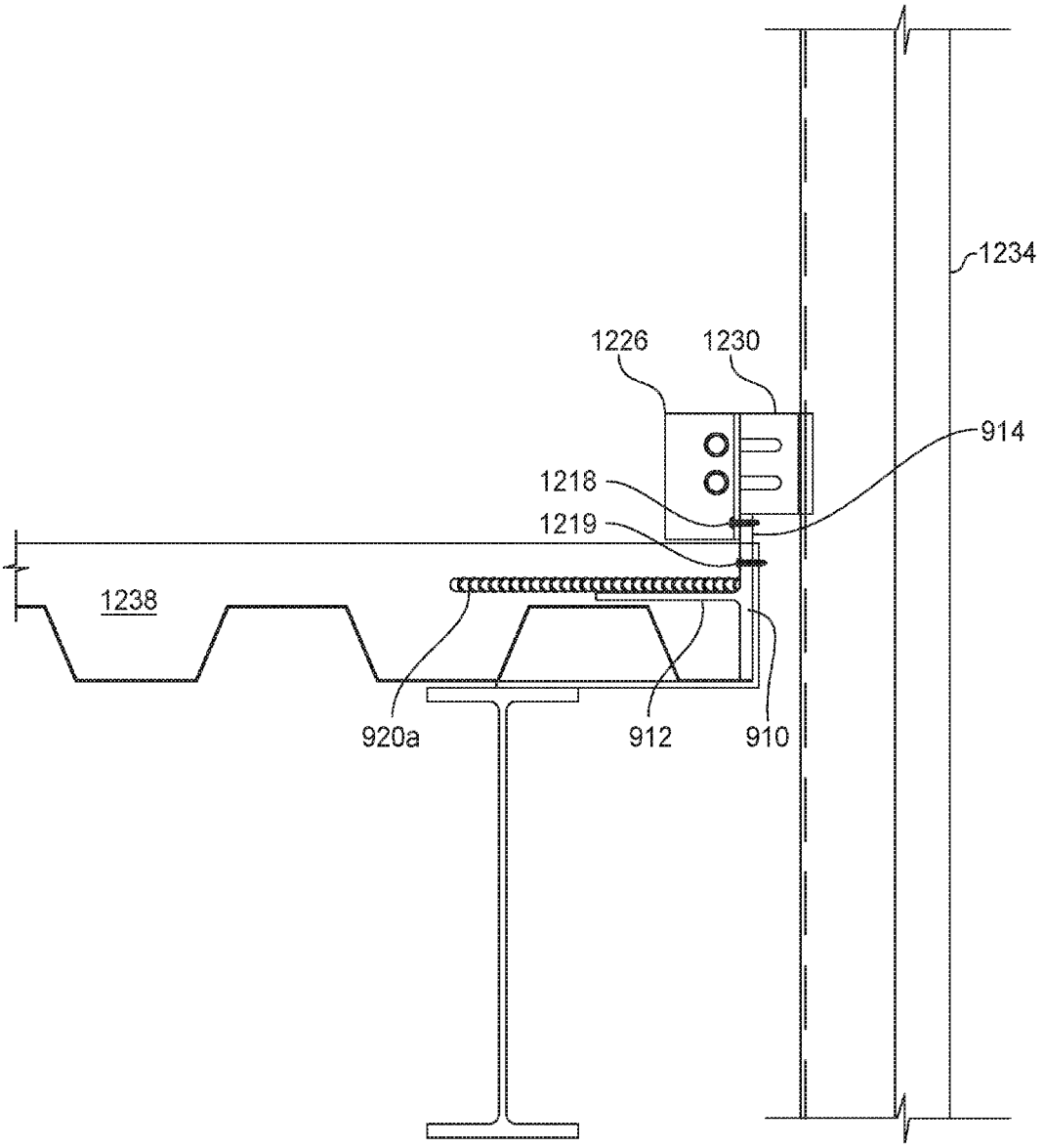
FIG. 12 is a partial fragmental vertical cross-section of a typical slab edge condition showing a preferred embodiment of an installed mullion anchoring system using the embed anchoring device of FIG. 9.

FIG. 12 shows a partial fragmental vertical cross-section of a typical slab edge condition showing an installed mullion anchoring system using the embed anchoring device 910 shown in FIG. 9. The horizontal web 912 and steel reinforcing bar 920*a* of the embed anchoring device are embedded in a concrete floor slab 1238 during concreting operations. The upwardly extended flange 914 of embed anchoring device 910 is positioned at the floor slab 1238 edge, and protrudes above the top floor slab surface.

The portion of upwardly extended flange 914 that protrudes above the top floor slab surface serves as a load resisting lip. The inward-facing surface of the load resisting lip contacts an outward-facing surface of a mullion connection bridge 1226. The mullion connection bridge 1226 is fastened to the load resisting lip of the embed anchoring device 910 with fastener 1218. The mullion connection bridge 1226 and mullion connection clip 1230 are connected as described for other embodiments. The mullion connection clip 1230 and mullion 1234 also are connected as described for other embodiments. Three-way construction tolerance adjustments are made as described for other embodiments. Dead load and negative wind load forces are transmitted from the mullion 1234 to the embed anchoring device 910 or to the concrete floor slab 1238 in similar fashion as described for the embodiment shown in FIGS. 7A and 7B.

Figure 13:
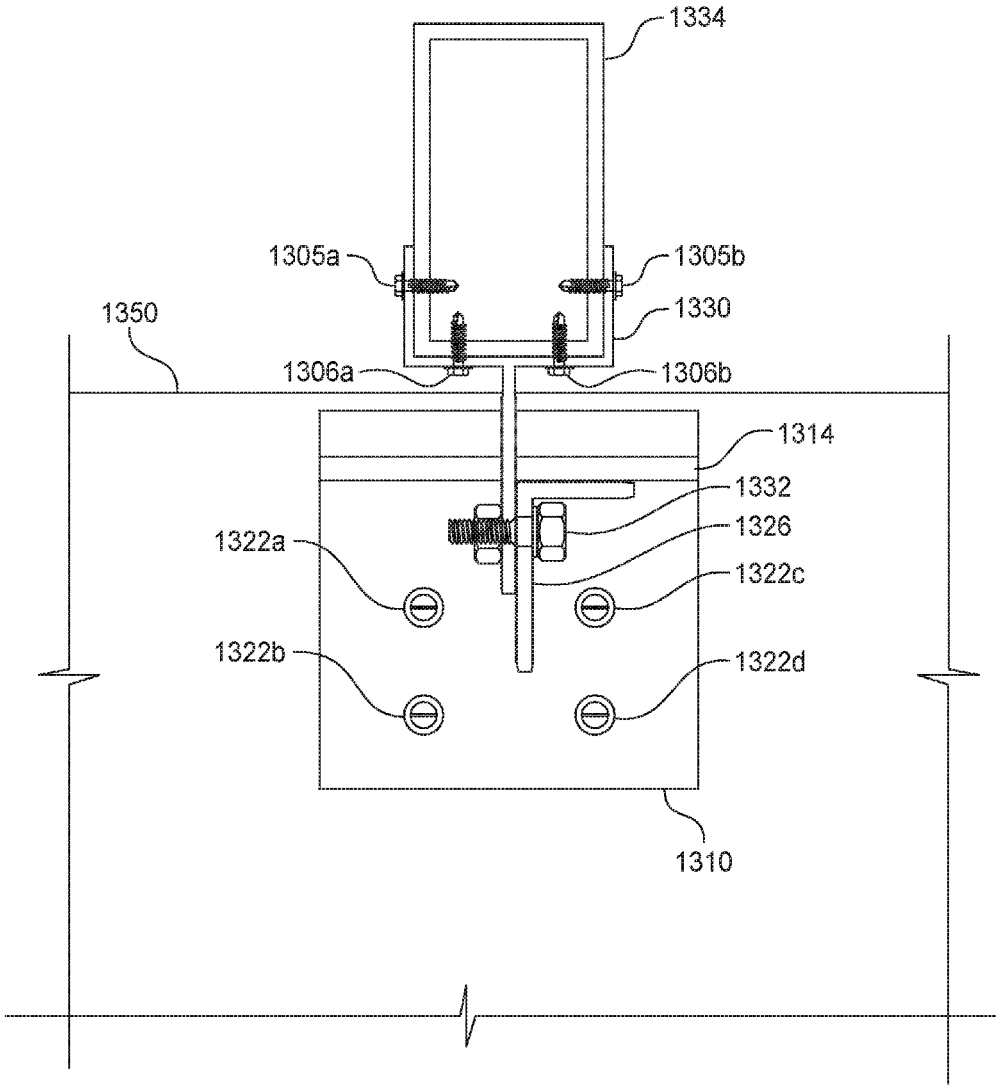
FIG. 13 is a top view of a preferred embodiment of a mullion anchoring system adapted for use with a typical conventional stick curtain wall system.
Figure 14:
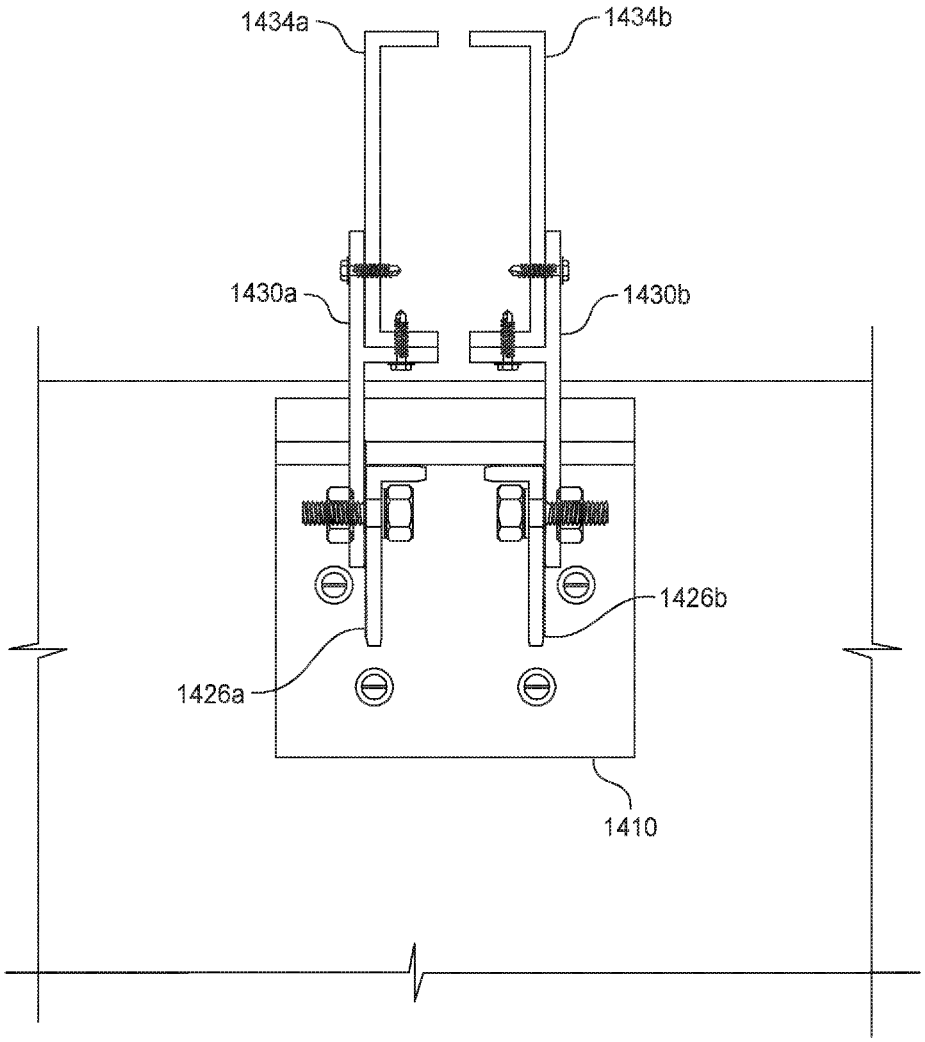
FIG. 14 is a top view of a preferred embodiment of a mullion anchoring system adapted for use with a typical conventional unitized curtain wall system.
Figure 15:
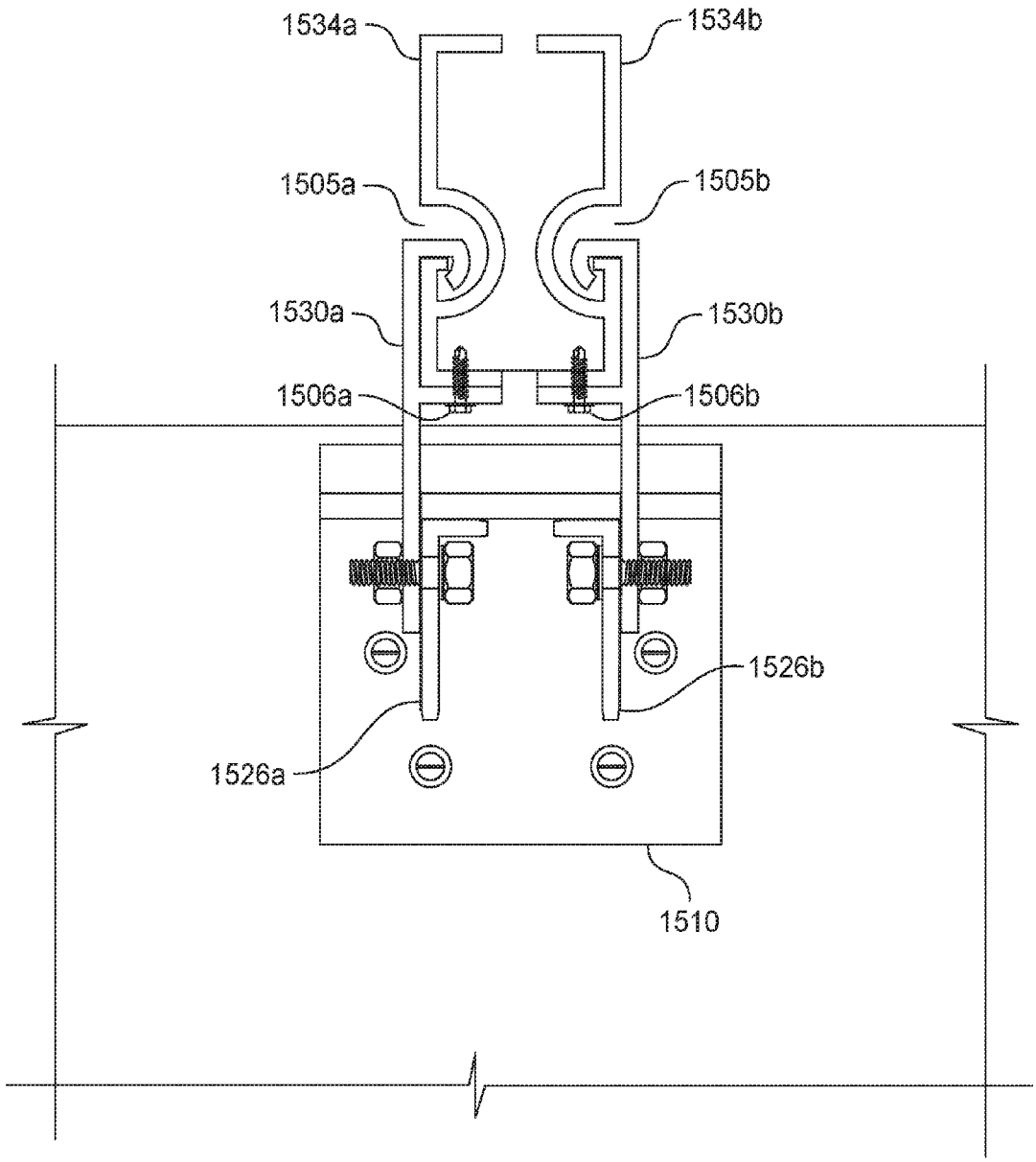
FIG. 15 is a top view of another preferred embodiment of a mullion anchoring system adapted for use with a typical conventional unitized curtain wall system.

FIGS. 13-15 show different mullion connection assembly embodiments. Unlike the previously described embodiments, the embodiments shown in FIGS. 13-15 do not use a slidable engagement between the mullion connection clip and mullion using matching male and female joints.

FIG. 13 shows a top view of a preferred embodiment of a mullion anchoring system adapted for use with a typical conventional stick curtain wall system. A stick mullion 1334 is secured to a mullion anchoring system. The mullion anchoring system has a mullion connection clip 1330, a mullion connection bridge 1326, and an anchoring device 1310. The shape of the mullion connection clip 1330 is adapted to conform with the profile of the stick mullion 1334. The mullion connection clip 1330 is secured to the sides of stick mullion 1334 with side fasteners 1305*a*, 1305*b* that resist negative wind load in shear. The mullion connection clip 1330 is further secured to the back of stick mullion 1334 with back fasteners 1306*a*, 1306*b* that resist dead load in shear. The mullion connection clip 1330 may be secured to the stick mullion 1334 using only side fasteners 1305*a*, 1305*b*, in which case the side fasteners 1305*a*, 1305*b* would resist both dead load and negative wind load in shear. The depth of the mullion connection clip/mullion engagement may be increased and additional fasteners may be added to accommodate higher reaction forces.

The connection between the mullion connection clip 1330 and mullion connection bridge 1326 and the connection between the mullion connection bridge 1326 and anchoring device 1310 are similar to the connections described for other embodiments.

For an embodiment with no back fasteners 1306*a*, 1306*b*, the field erection procedures are as follows. Place the anchoring device 1310 at the approximate location of the mullion 1334 near the floor slab edge 1350 and secure the anchoring device 1310 to the top of the floor slab with concrete fasteners 1322*a*, 1322*b*, 1322*c*, 1322*d*. With the dead weight of stick mullion 1334 temporarily supported at the correct up/down location and at the approximate in/out and left/right locations, place the loosely shop-assembled mullion connection assembly (i.e., the mullion connection clip 1330, mullion connection bridge 1326, and bolt 1332) on top of the anchoring device 1310 such that the mullion connection bridge 1326 is behind the load resisting lip 1314 of the anchoring device 1310. Hand-tighten the bolt 1332 that secures the mullion connection bridge 1326 with the mullion connection clip 1330. Secure the mullion connection clip 1330 to the stick mullion 1334 with side fasteners 1305*a*, 1305*b*. In this manner, the mullion anchoring system automatically secures the mullion 1334 to the floor slab at the correct up/down location (i.e., the mullion anchoring system automatically absorbs up/down construction tolerance deviations). In/out construction tolerance adjustments are made using a slotted hole in either the mullion connection clip 1330 or the mullion connection bridge 1326, adjusting the in/out position of the mullion connection clip 1330 relative to the mullion connection bridge 1326, and tightening bolt 1332, as described for other embodiments. As with previously described embodiments, left/right construction tolerance adjustments are made by simply placing the mullion connection bridge in contact with the load resisting lip 1314 of the anchoring device 1310 at the proper left/right location. The mullion connection bridge 1326 may then be fastened to the load resisting lip 1314 with a fastener, as described for other embodiments.

If the back fasteners 1306*a*, 1306*b* are used, they can be fastened to the mullion connection clip 1330 and stick mullion 1334 when the side fasteners 1305*a*, 1305*b* are placed. Prior to inserting the back fasteners 1306*a*, 1306*b*, the mullion connection bridge 1326 may be temporarily removed by removing bolt 1332, in order to access the insertion point for the back fasteners 1306*a*, 1306*b*. The mullion connection bridge 1326 can be reattached to the mullion connection clip 1326 after back fasteners 1306*a*, 1306*b* are secured.

FIG. 14 shows a top view of a mullion anchoring system embodiment adapted for use with a typical conventional unitized curtain wall system. As shown, the half mullions 1434*a*, 1434*b* are a symbolic representation of a vertical joint of a unitized system. The actual vertical joint is a weather-sealed joint with a male/female joint engagement made in the field. Therefore, the total mullion width of the two half mullions 1434*a*, 1434*b* together varies from joint to joint. For that reason, two separate mullion connection assemblies are used, one for each half mullion 1434*a*, 1434*b*. Each mullion connection assembly has a mullion connection clip 1430*a*, 1430*b* and a mullion connection bridge 1426*a*, 1426*b*. Both mullion connection assemblies may be connected to a single anchoring device 1410. Other than the use of two separate mullion connection assemblies, the structural explanations and erection procedures for this mullion anchoring system embodiment are the same as explained for the embodiment of FIG. 13.

FIG. 15 shows a top view of another mullion anchoring system embodiment adapted for use with a typical conventional unitized curtain wall system. Similar to the embodiment shown in FIG. 14, this embodiment has a single anchoring device 1510 connected to two mullion connection assemblies, each with a mullion connection bridge 1526*a*, 1526*b* and a mullion connection clip 1530*a*, 1530*b*. The mullion anchoring system is used to anchor two half mullions 1534*a*, 1534*b*. In this embodiment, the half mullions 1534*a*, 1534*b* and mullion connection clips 1530*a*, 1530*b* have matching profiles for forming a structural engaged joint 1505*a*, 1505*b* between each half mullion 1534*a*, 1534*b* and the corresponding mullion connection clip 1530*a*, 1530*b*.

The structural engaged joint 1505*a*, 1505*b* is used instead of the side fasteners used in the embodiment shown in FIG. 14. The structural engaged joint resists negative wind load. Back fasteners 1506*a*, 1506*b* are provided to resist dead load.

Although FIGS. 13-15 show mullion anchoring system embodiments using an anchoring device secured to a concrete slab using fasteners, the mullion connection assembly embodiments shown in FIGS. 13-15 may be used with different types of anchoring devices, such as the embed anchoring devices shown in FIGS. 9-11.

Figure 16:
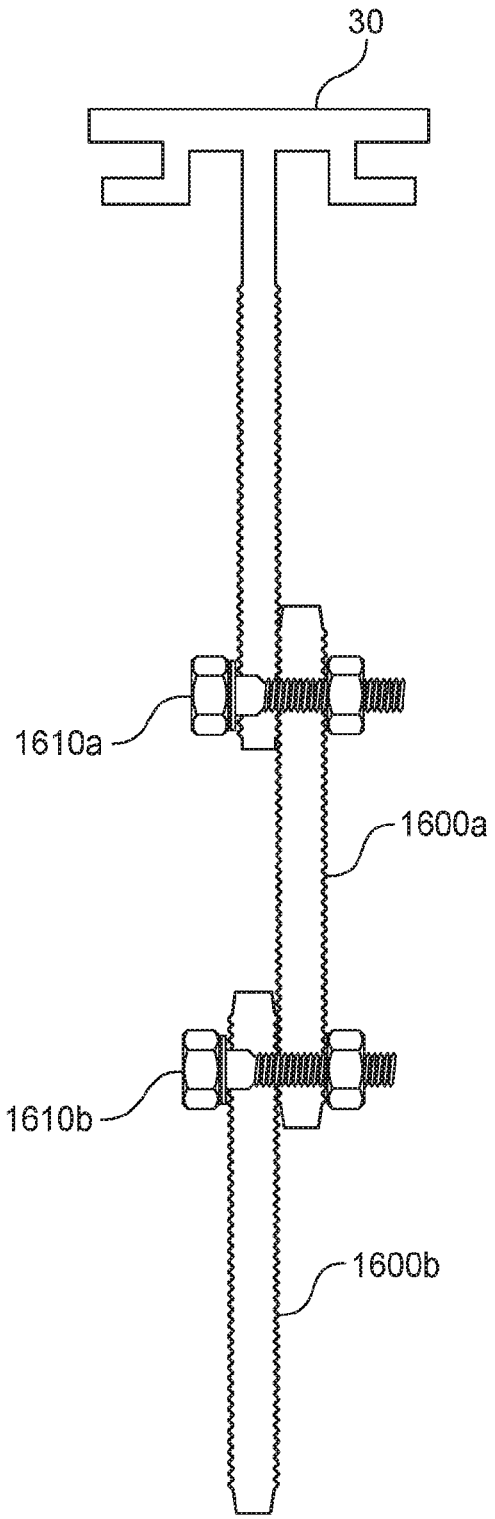
FIG. 16 shows a mullion connection clip with extenders for increasing allowable in/out construction tolerance adjustments for use in preferred embodiments of a mullion anchoring system.

FIG. 16 shows a preferred mullion connection clip 30 with extenders 1600*a*, 1600*b*. Extenders may be used to increase the allowable in/out construction tolerance adjustment in the event elongated holes in the mullion connection clip or mullion connection bridge are insufficient to make the needed in/out construction tolerance adjustment. FIG. 16 shows an embodiment with two extenders 1600*a*, 1600*b*. The extenders 1600*a*, 1600*b* have serrations that match the serrations on the mullion connection clip 30. The serrations structurally interlock to prevent relative in/out sliding between the mullion connection clip and the first extender 1600*a*, between the first extender 1600*a* and the second extender 1600*b*, and between the second extender 1600*b* and the mullion connection bridge (not shown). Each extender 1600*a*, 1600*b* has elongated holes for making the desired in/out construction tolerance adjustment. Once the desired in/out construction tolerance adjustment is made, the mullion connection clip 30 and the extenders 1600*a*, 1600*b* are secured together with fasteners 1610*a*, 1610*b*.

Figure 17:
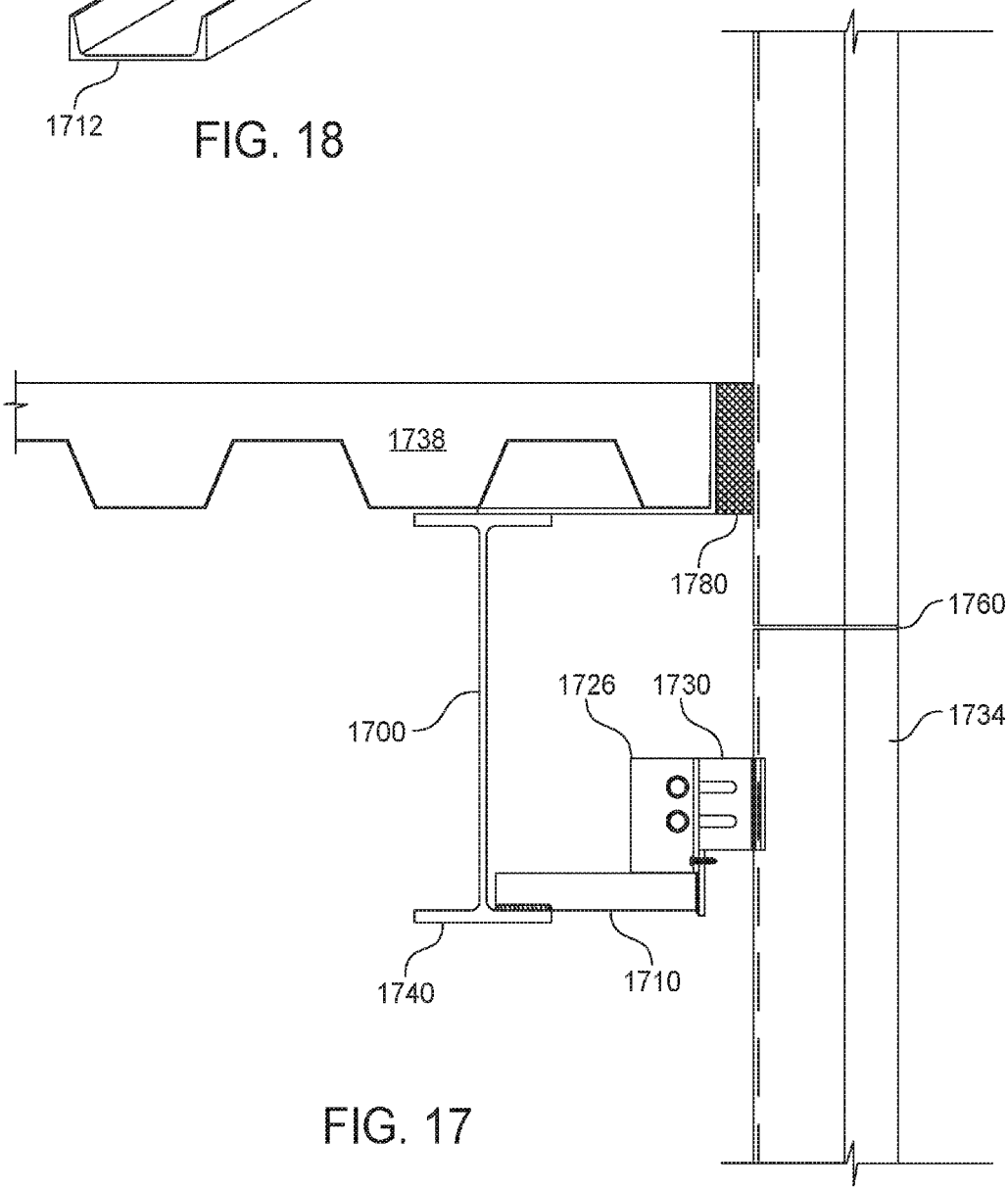
FIG. 17 is a partial fragmental vertical cross-section of a typical slab edge condition showing another preferred embodiment of an installed mullion anchoring system, secured to a spandrel beam.

FIG. 17 shows a partial fragmental vertical cross-section of a typical slab edge condition showing an installed mullion anchoring system of another preferred embodiment of the present invention. In this embodiment, a mullion 1734 is anchored to a spandrel beam 1700 beneath a concrete floor slab 1738. An anchoring device 1710 is welded to the top of the bottom flange 1740 of the spandrel beam 1700. A mullion connection bridge 1726 and mullion connection clip 1730 form a mullion connection assembly that is connected to the anchoring device 1710 and mullion 1734 in the same manner as described for other embodiments.

In this embodiment, the mullion splice joint 1760 is below the floor slab and hidden from interior view. Upon installation of inter-floor fire safing 1780, interior floor surface is maximized. Placing the mullion anchoring device below the concrete floor slab 1738 also permits the architectural feature of unobstructed vision glass down to the interior floor line.

Figure 18:
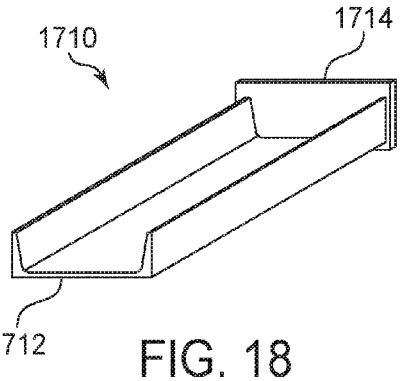
FIG. 18 is an isometric view of the anchoring device depicted in the installed mullion anchoring system of FIG. 1.

FIG. 18 shows the anchoring device 1710 used in the embodiment shown in FIG. 17. This anchoring device embodiment has a steel channel 1712 and a load resisting lip 1714 welded to the end of the steel channel 1712. The steel channel 1712 may be welded to a spandrel beam, as shown in FIG. 17, or secured to other building structural elements by other means that would be apparent to those of skill in the art.

In another embodiment, a mullion may be anchored against wind load by anchoring the mullion to an anchoring device attached to a spandrel beam. In this embodiment, the anchoring device is an angle with a horizontal leg and a downwardly extended leg. The horizontal leg is secured to a spandrel beam (e.g., by welding) at a location near the top flange. The downwardly extended leg provides a load resisting lip. A mullion connection assembly including a mullion connection bridge and mullion connection clip in connected with the anchoring device in a similar manner as the previously-described embodiments, except with an upside-down configuration. Like the previously-described embodiments, an inward facing surface of the load resisting lip is in contact with an outward facing surface of the mullion connection bridge, and that contact resists negative wind load. The mullion connection bridge may be secured to the load resisting lip of the anchoring device using a fastener. Dead load may be transferred to a different anchoring location along the length of the mullion (e.g., via a dead load anchor near the top of the mullion).

One of ordinary skill in the art would understand various ways to resist positive wind load. For example, a bracket may be secured on the inside of the mullion connection bridge of the described embodiments of the present invention.

Nothing in the above description is meant to limit the present invention to any specific materials, geometry, or orientation of elements. Various changes could be made in the construction and methods disclosed above without departing from the scope of the invention are contemplated within the scope of the present invention and will be apparent to those skilled in the art. For example, the figures show preferred embodiments in which the load resisting lip and corresponding contacting surface of the mullion connection bridges are vertical, but those components in other embodiments may be angled. For example, the preferred embodiments shown in the figures can be adapted for anchoring a sloped mullion. In general, the load resisting lip and corresponding contacting surface of the mullion connection bridges of the preferred embodiments may be adapted to a sloped mullion by modification such that those components are parallel to the centroidal axis of the mullion. The embodiments described herein were presented by way of example only and should not be used to limit the scope of the invention.

The invention claimed is:

1. A curtain wall anchoring system comprising:

an anchoring device, a mullion connection bridge, and a mullion connection clip, said anchoring device secured to a building structure and comprising a load resisting lip having an inward-facing surface, said mullion connection bridge having an outward-facing surface in contact with said inward-facing surface of said load resisting lip, said load resisting lip extending in a direction toward the mullion connection clip, said mullion connection clip secured to said mullion connection bridge and secured to a mullion, wherein in and out construction tolerance adjustments can be made by relative positioning between said mullion connection bridge and said mullion connection clip, and wherein said in and out construction tolerance adjustments are perpendicular to the length of said mullion.

2. The curtain wall anchoring system of claim 1, wherein a contact pressure develops between said inward-facing surface and said outward-facing surface under a negative wind load, wherein said contact pressure resists said negative wind load.

3. The curtain wall anchoring system of claim 1, wherein said load resisting lip and said mullion connection bridge provide left and right construction tolerance adjustability by relative positioning of said load resisting lip and said mullion connection bridge.

4. The curtain wall anchoring system of claim 3, wherein said right and left construction tolerance adjustments can be made to any right or left location along an edge of a floor slab.

5. The curtain wall anchoring system of claim 1, wherein said anchoring device is secured to said building structure by attachment to a floor slab.

6. The curtain wall anchoring system of claim 5, wherein said anchoring device is attached to said floor slab using concrete screw anchors.

7. The curtain wall anchoring system of claim 1, wherein said mullion connection clip comprises a slotted hole to permit said in and out construction tolerance adjustments.

8. The curtain wall anchoring system of claim 1, wherein said mullion connection clip is slidably engaged with said mullion using matching male and female joints.

9. The curtain wall anchoring system of claim 8, wherein up and down construction tolerance adjustments can be made by relative positioning of said mullion connection clip to any up or down location along the length of said mullion.

* * * * *